United States Patent [19]

Neuman et al.

[11] 3,945,362

[45] Mar. 23, 1976

[54] INTERNAL COMBUSTION ENGINE IGNITION SYSTEM

[75] Inventors: John G. Neuman, Grosse Pointe; Richard W. Johnston, Troy, both of Mich.

[73] Assignee: General Motors Corporation, Detroit, Mich.

[22] Filed: Dec. 4, 1973

[21] Appl. No.: 421,579

Related U.S. Application Data

[63] Continuation-in-part of Ser. No. 397,766, Sept. 17, 1973, abandoned.

[52] U.S. Cl. ..... 123/148 E; 315/209 T

[51] Int. Cl.[2] ..... F02P 1/00

[58] Field of Search ..... 123/148 E; 315/209 T

[56] References Cited

UNITED STATES PATENTS

| | | | |
|---|---|---|---|
| 3,280,809 | 10/1966 | Issler | 123/148 E |
| 3,489,129 | 1/1970 | Issler | 123/148 OC |
| 3,549,944 | 12/1970 | Minks | 123/148 E |
| 3,575,154 | 4/1971 | Taylor | 123/148 E |
| 3,593,696 | 7/1971 | Guido | 123/148 E |
| 3,725,732 | 4/1973 | Thakore | 123/148 E |
| 3,749,973 | 7/1973 | Canup | 123/148 E |

FOREIGN PATENTS OR APPLICATIONS

| | | | |
|---|---|---|---|
| 1,291,353 | 3/1962 | France | 123/148 E |

*Primary Examiner*—Charles J. Myhre
*Assistant Examiner*—Ronald B. Cox
*Attorney, Agent, or Firm*—Richard G. Stahr

[57] ABSTRACT

An internal combustion engine ignition system wherein both arc-creating and arc-maintaining voltages are applied to the spark plug or plugs through a single ignition transformer energized through a single primary circuit in the well-known "Kettering" circuit. A switch in the primary circuit, preferably a transistor, repeatedly switches "on" and "off" to create a plurality of primary current on and current off events during each ignition period. The ignition coil primary to secondary turns ratio, the duration of the current on and current off events, and the various circuit parameters are chosen (a) to create by transformer action an ignition arc-sustaining potential of sufficient magnitude to maintain a previously initiated ignition arc across the spark plug arc gap as the current builds up during each current on event; (b) to generate an initial high inductive discharge arc-striking voltage spike across the spark plug air gap when the switch is abruptly switched off at the commencement of the subsequent current off event; and (c) to create a sustained arc-maintaining voltage for the balance of the switch off event after the arc is struck due to the inductive current decrement under arcing conditions. As a consequence of this action, the arc is normally struck at the inception of the first off event and is maintained until after the last on event, and at the same time the arc may be restruck at the commencement of any of the subsequent off events should it go out.

16 Claims, 10 Drawing Figures

INTERNAL COMBUSTION ENGINE IGNITION SYSTEM

Figure 1:
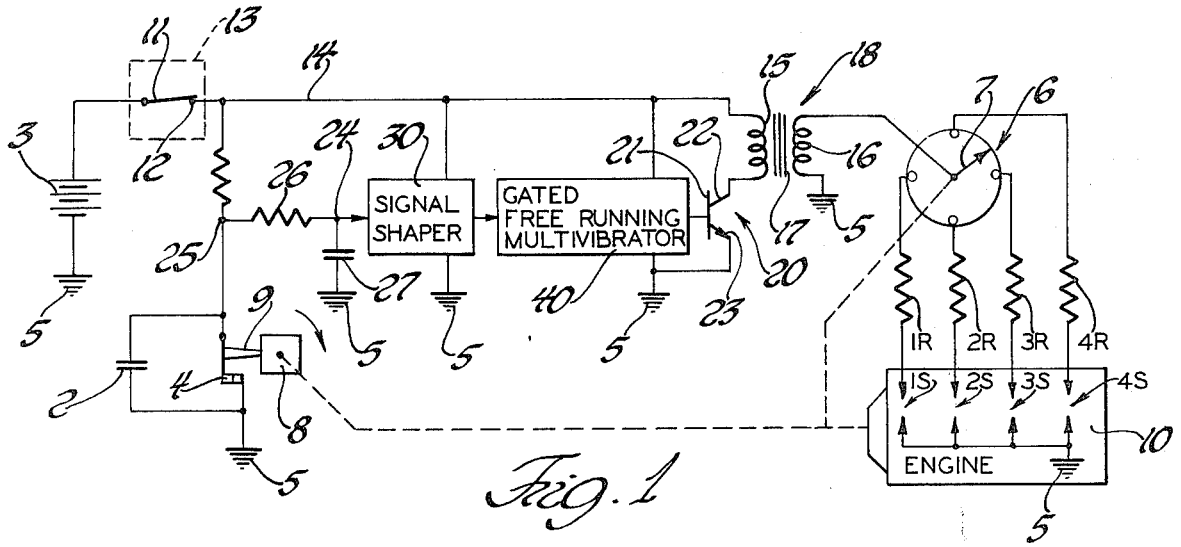

This application is a continuation-in-part of copending application Ser. No. 397,766, filed Sept. 17, 1973 now abandoned.

This invention relates to an internal combustion engine ignition system and, more specifically, to an internal combustion engine ignition system which produces an ignition spark or arc of a predetermined, relatively prolonged, duration for each engine cylinder and has restrike capability at successive times during such duration.

As is well known in the automotive art, the combustible fuel-air mixture in each of the cylinders of an internal combustion engine during each compression stroke is ignited at or near the conclusion of the compression stroke by an electrical spark produced by the associated ignition system. The ignition spark or arc, therefore, must be of sufficient intensity to initiate combustion of sufficient duration to insure that combustion is reliably established, and of sufficient energy to provide complete combustion. Further, it is desirable that the arc re-establish itself if for any reason it is lost.

The system of the present invention advantageously uses the characteristic of an arc to be maintained by a relatively low voltage, once established. At the same time, if arc blowout occurs, it is restarted by the recurrent arc-creating voltage spikes. It operates in a transformer mode during each primary current on period, in an inductive discharge mode during the initial part of each current off period and in an inductive current decrement mode during the balance of each current off period. In brief, the ignition system utilizes the general circuit arrangement of the transformer or Kettering type ignition system, using a simple transformer connection with a primary current control switch. However, the primary switch (preferably a transistor) is switched on and off a plurality of times (e.g., 7 times) during each ignition period (e.g., a period of 7.5 milliseconds). During each on time, primary current flow, and transformer magnetic flux, increase at a substantially constant rate. This induces in the secondary winding an approximately constant voltage of, for example, 3 killovolts due to transformer action. This voltage value is sufficient to create across the spark plug arc terminals a voltage in excess of the approximately 800 volts required to maintain an arc, if previously established. By the use of a very short on period (such as 500 microseconds), the required approximately constant time rate of transformer flux increase is achieved with a relatively small sized transformer core and correspondingly smaller overall transformer size than would otherwise be required. In this fashion the successive on periods take advantage of the relatively low voltage requirement for maintaining the arc, once established. At the same time, however, the current increases progressively during each on period so that at the end of the period when primary current is abruptly terminated (at a time when there is no arc), an arc-creating voltage spike, such as 15 kilovolts or more, is created across the transformer secondary. This voltage spike is characterized by an exceptionally high rate of voltage rise, making it unusually effective in establishing the arc. This action is similar to that of a conventional Kettering inductive discharge ignition system, except that a plurality of such primary current off events occur during each ignition period, providing a succession of times of arc-restrike capability, and the rate of voltage rise is exceptionally rapid. Further, since the on time can be (and preferably is) made independent of engine speed, and is very short, the transformer size and switching duty cycle need not handle the heavy currents normally associated with engine cranking or low engine speed and maintained at a relatively constant value before interruption. After the arc-creating high voltage spike on each off period, the voltage quickly falls to a lower voltage associated with the inductive decrement type of current flow through the arc. For the duration of the off period, however, the voltage at the spark plug is maintained at an arc-maintaining value (i.e., over about 800 volts).

In its preferred form, the system of the present invention provides a first current on event of about 600 micro-seconds and subsequent current on and current off events of about 500 microseconds each and undergoes about seven on events during each ignition period. With approximately these time parameters it has been found possible to achieve, with a relatively small transformer, a conspicuously rapid rate of voltage rise at the inception of each current off event (e.g., voltage rise in 10–20 microseconds) up to an arc-striking voltage spike of over 15 kilovolts, while maintaining for the remainder of each off event and for the duration of each on event an arc-maintaining secondary voltage of about 3 kilovolts. Preferably, a resistance is provided in the secondary winding circuit to minimize reaction on the primary circuit due to secondary currents and thereby limit the duty cycle of the switch. Various arrangements can be used to control the total arc duration and the primary current value at the time of interruption. In the preferred form of the invention, the duration of the arc is increased at reduced engine speed and the primary current value at the time of each termination is maintained substantially uniform throughout the ignition event.

The present invention may be mechanized in various ways. In the form specifically described hereafter, the switch is in the form of a transistor having its emitter-collector electrodes in series with the transformer primary. A substantially square wave voltage of value sufficient to cause alternate events of maximum conduction and nonconduction through the emitter-collector electrodes is applied to the base-emitter electrodes for a predetermined time, such as 7.5 milliseconds, constituting the ignition period. These alternate events have a fundamental frequency that is relatively high, such as one kilohertz. This frequency is determined by the total of the time period required to bring the primary current to a value that is capable of striking an arc, when interrupted, and the time period during which the current can be off and the arc reliably sustained. Either a longer or a shorter period that is required for this action is undesirable. This provides, for example, a succession of eight on periods of 500 microseconds each separated by seven off periods of like length. Suitable timing mechanism operated by the engine initiates the first on period at proper time in advance of desired first ignition to terminate that on period and start the first off period when the arc is to be established.

More particularly, in the preferred mechanism herein described specifically, a free-running multivibrator generates the switching wave and is gated by a sharp "start" pulse established in response to engine rotation.

Suitable timing means gates the multivibrator off at the conclusion of the ignition period. An alternative mechanization, which may be preferable under some circumstances, is described and claimed in the copending U.S. patent application Ser. No. 401,505, assigned to the same assignee as the present invention.

In accordance with a further feature of the present invention, a substantial resistance, such as 30 kilohms, an provided in the secondary circuit of the transformer. This resistance reduces the current flow in the secondary under transformer action, and accordingly, the primary current. While such resistance tends to degrade performance of the secondary circuit, it has been found that on balance a significant overall benefit is achieved.

The system of the present invention can create an arc for whatever period is desirable, within a broad range of values. In accordance with one feature of the present invention, this capability is advantageously used to provide a longer arc duration when the engine is cranking or running slowly than at higher engine speeds. Further, in accordance with another feature of the present invention, the duration of each on period is controlled so as to compensate for the initial current value that occurs when the prior off period is terminated while the arc exists.

It is, therefore, a general object of this invention to provide an improved internal combustion engine ignition system.

It is an additional object of this invention to provide an improved internal combustion engine ignition system which produces an ignition arc and maintains the arc for a predetermined period of time, through mechanism that advantageously uses the lessened voltage requirement for arc-maintenance and succession of primary on and off current periods for each ignition event, coupled with transformer action at some times, inductive discharge action at other times, and inductive decrement action at still other times.

It is another object of this invention to provide an improved internal combustion engine ignition system in which an arc restrike capability is provided at the inception of each of a plurality of primary current off periods during each ignition event, and an arc-maintaining capability exists at all other times.

It is another object of the present invention to provide an improved internal combustion engine ignition system in which a plurality of ignition coil primary winding current on and current off periods occur during each ignition event and wherein the system is so constructed and arranged that an arc-establishing voltage is created and thereafter a voltage normally capable of maintaining the arc continuously subsists for the balance of a plurality of current on and current off periods composing the ignition event.

A more specific object of the present invention is to provide an improved internal combustion engine ignition system wherein current on and current off periods occur in the ignition coil primary winding at a repetition rate of about 1 millisecond, and during a period of a plurality of cycles defining the balance of the ignition event, during which time the secondary voltage is maintained at a voltage sufficient to provide an arc-sustaining voltage in excess of about 800 volts of the spark plug terminals so as to maintain the arc.

Still another object of the present invention is to provide an improved internal combustion engine ignition system wherein the above-described action takes place, the system is characterized by an ignition coil of comparatively small size, a high rate of voltage rise on each current off period, and a suitability for use with semiconductor switch elements, and necessary controls that are reliable, inexpensive and otherwise practical in internal combustion engine ignition systems, and further is characterized by a high degree of flexibility for the accommodation of differing engine requirements.

Figure 1A:
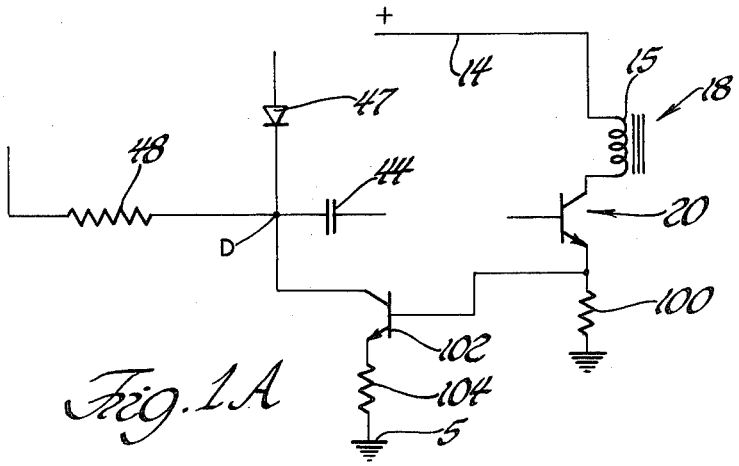

For a better understanding of the present invention, together with additional objects; advantages, and features thereof, reference is made to the following description and accompanying drawings in which:

FIG. 1 sets forth an internal combustion engine ignition system of this invention in schematic form;

FIG. 1A is a fragmentary circuit diagram of an illustrative current feedback arrangement for controlling the transformer primary on time.

Figure 2:
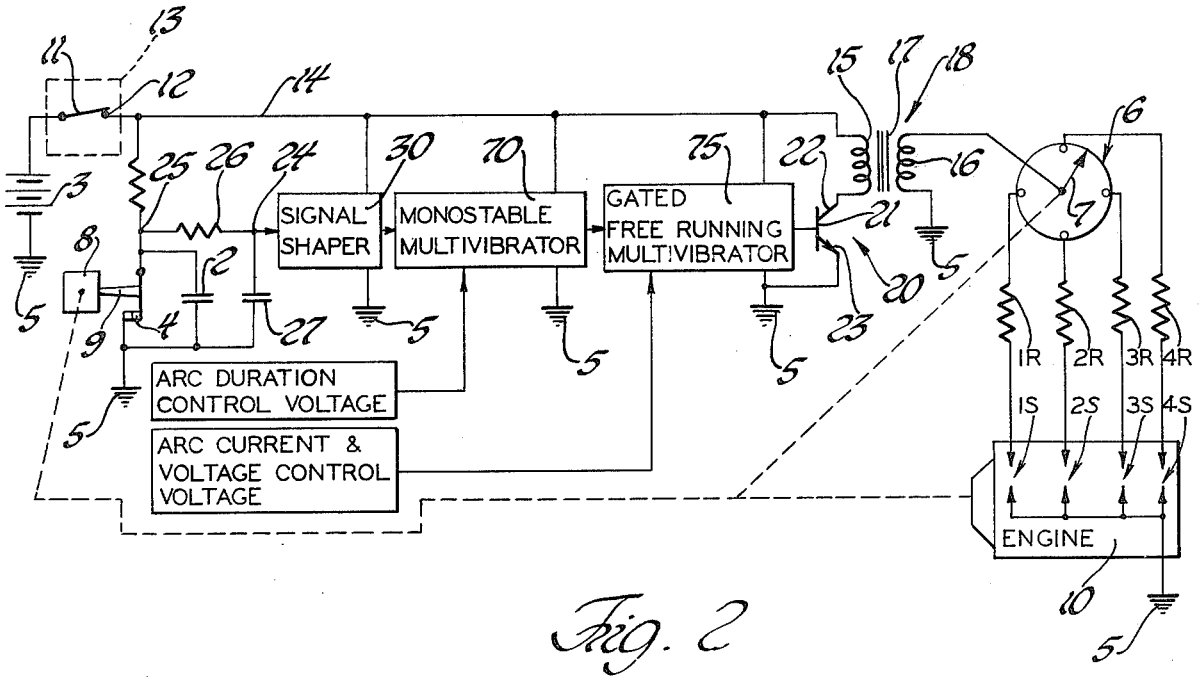
Figure 3:
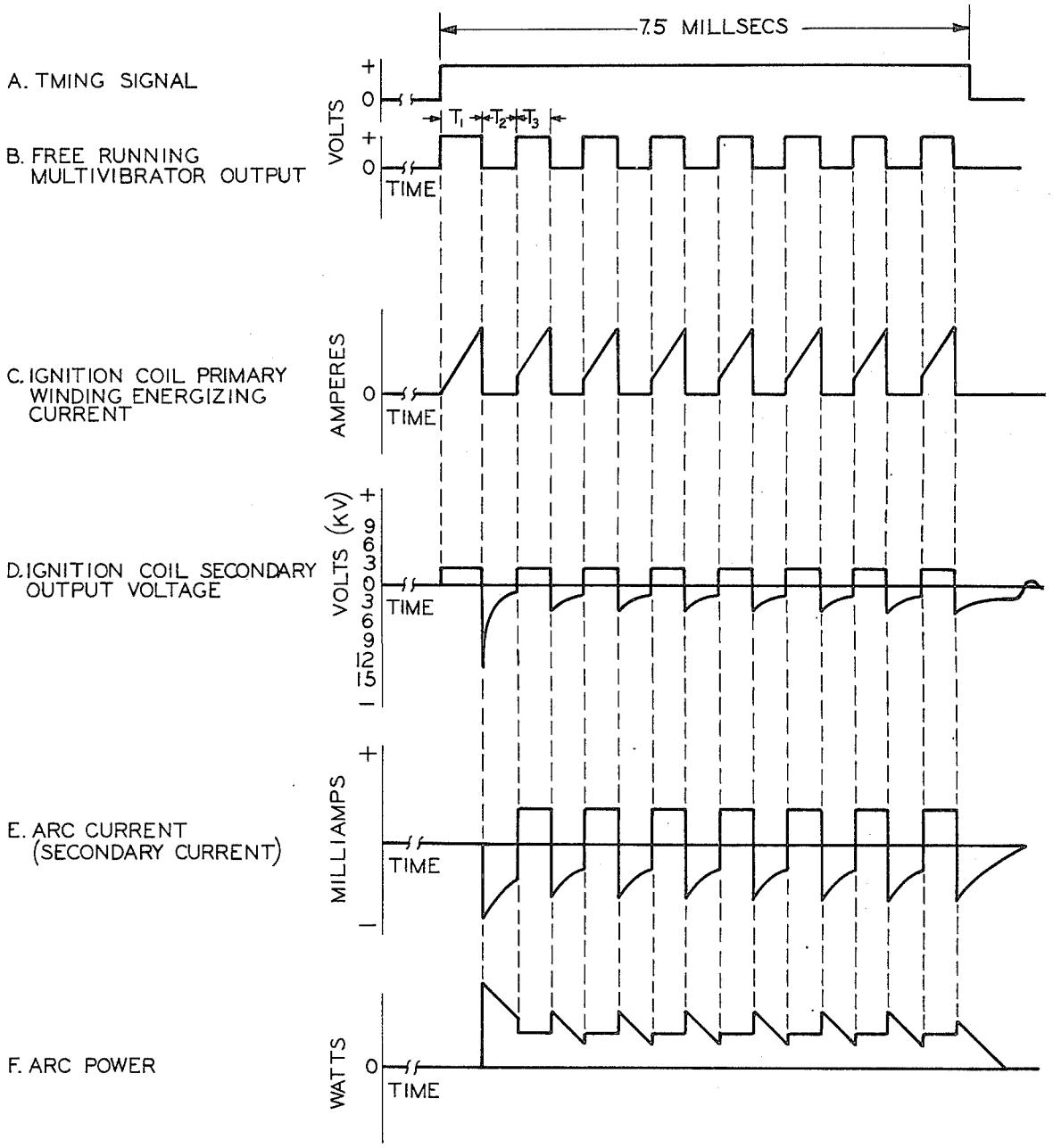

FIG. 2 sets forth an alternate embodiment of the internal combustion engine ignition system of this invention in schematic form;

FIG. 3 is a set of curves useful in understanding the operation of the circuitry of FIGS. 1 and 2, the curves showing operation with on time period termination at a fixed current value.

Figure 4:
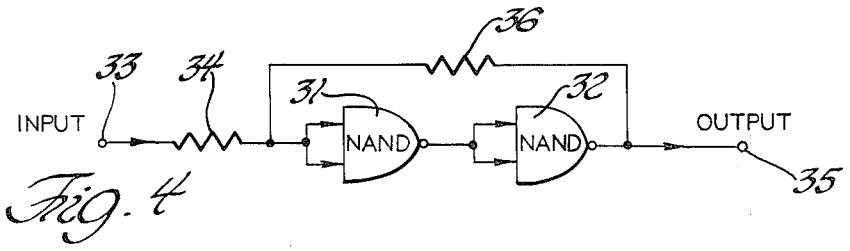
Figure 5:
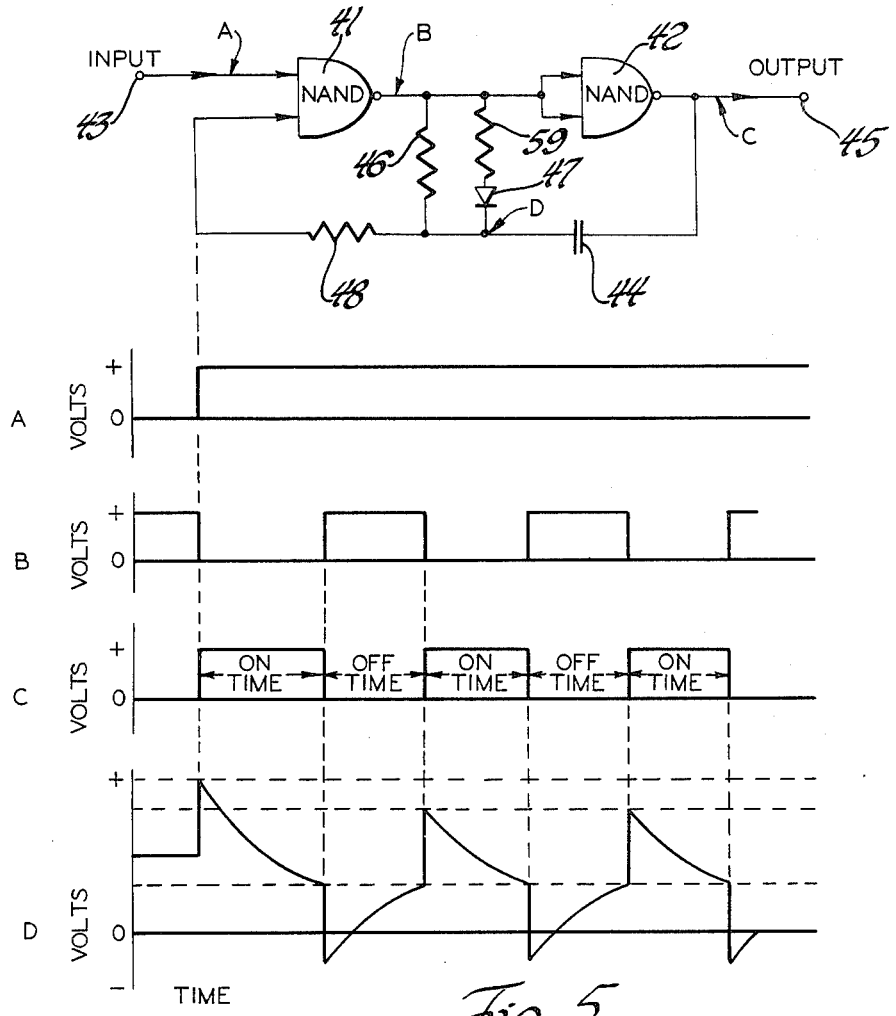
Figure 6:
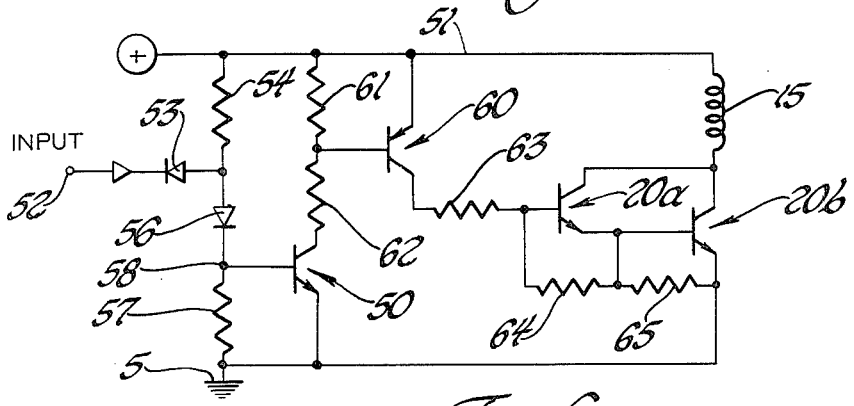
Figure 7:
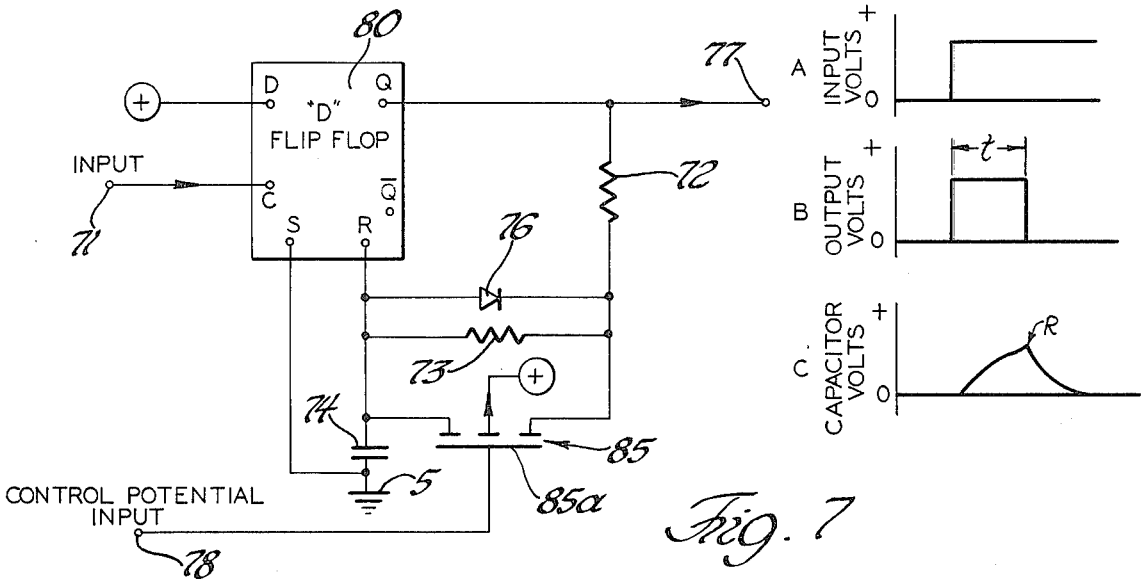
Figure 8:
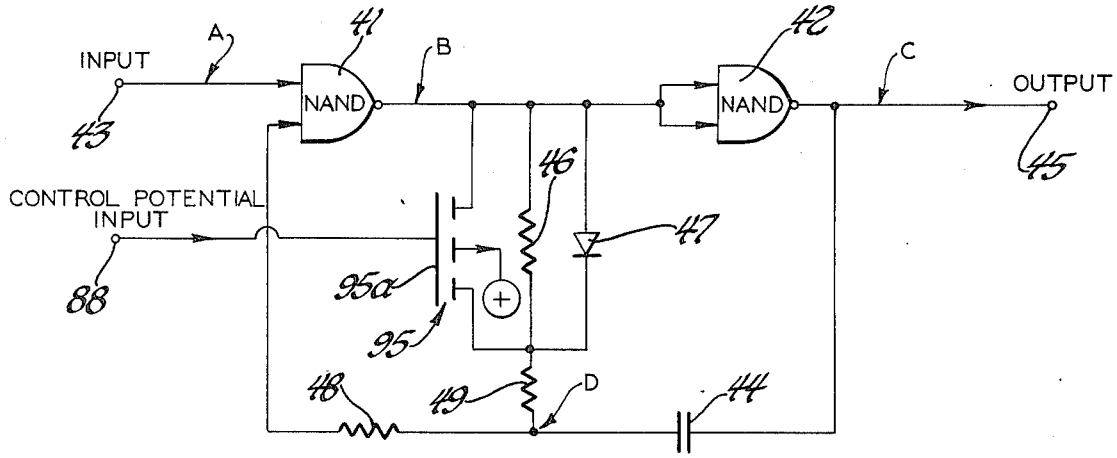
Figure 9:
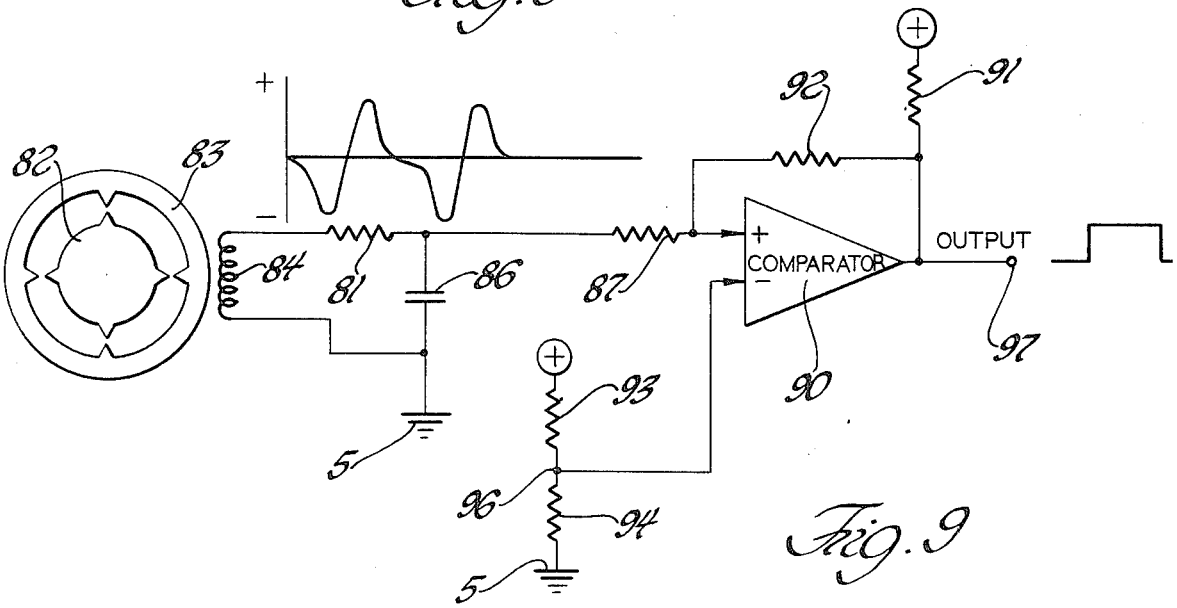

FIG. 4 sets forth, in schematic form, a signal shaper circuit suitable for use with the ignition system of this invention;

FIG. 5 sets forth, in schematic form, a gated free-running multivibrator circuit suitable for use with the ignition system of this invention as set forth in FIG. 1;

FIG. 6 sets forth, in schematic form, a transistor driver circuit suitable for use with the gated free-running multivibrator circuits of FIGS. 5 and 8;

FIG. 7 sets forth, in schematic form, a potential controllable monostable multivibrator circuit suitable for use with the ignition system of this invention as set forth in FIG. 2;

FIG. 8 sets forth, in schematic form, a potential controllable gated free-running multivibrator circuit suitable for use with the ignition system of this invention as set forth in FIG. 2; and FIG. 9 sets forth, in schematic form, a circuit arrangement for electromagnetically producing ignition signals for the embodiments of the ignition system of this invention of both FIGS. 1 and 2.

Point of reference or ground potential has been illustrated in FIGS. 1, 2, 6, 7 and 9 by the accepted schematic symbol and referenced by the numeral 5.

GENERAL SYSTEM DESCRIPTION

The internal combustion engine ignition system of this invention will be briefly described with reference to FIGS. 1, 2 and 6. Transistor 20 of FIGS. 1 and 2 and the transistor Darlington pair **20*a* and 20*b* of FIG. 6 function as the electrical switching device in the energizing circuit of the ignition coil primary winding 15** and, therefore, are operated in On and Off modes, being conductive through the collector-emitter electrodes during the On mode and not conductive through the collector-emitter electrodes during the Off mode. The primary winding energizing circuit switching transistor is operated to the On mode each time an ignition arc is to be initiated and, independent of engine operation, to the Off mode after a predetermined On mode time and thereafter alternately to thee On and Off modes for a predetermined period of time during which ignition spark energy is to be applied to the engine spark plug across the electrodes of which an ignition arc has been initiated. Each time the switching transistor is operated to the On mode to establish the ignition coil primary winding energizing circuit, the increasing flow of primary winding energizing circuit through the primary winding produces a changing magnetic field which links the secondary winding and induces, by transformer action, in the secondary winding an ignition arc-sustaining potential which is of a sufficient magnitude to maintain any previously initiated ignition arc. Each time the switching transistor is operated to the Off mode to abruptly interrupt the primary winding energizing circuit, the abrupt interruption of primary winding energizing current flow results (if there is no arc) in a rapidly collapsing magnetic field which induces, by induction coil action, in the secondary winding an ignition arc-initiating potential which is of a sufficient magnitude to initiate an ignition arc across the electrodes of the engine spark plug to which it is directed. The ignition coil primary winding has an inductance value which, with rated energizing current flow therethrough, will store sufficient energy to maintain the initiated ignition arc in inductive decrement action, until the next operation of the switching transistor to the On mode. The internal combustion engine ignition system of this invention, therefore, provides an ignition arc for the duration of the predetermined period of time during which ignition spark energy is to be supplied to each engine spark plug and, additionally, has the capability of re-initiating the ignition arc each time the switching transistor is operated to the Off mode should the ignition arc extinguish during any of the predetermined periods of time. To provide these features, the ignition coil must have a primary to secondary winding turns ratio, for example of the order of 1:200 with a 12 volt system, such that the increasing primary winding energizing current flow while the switching transistor is in the On mode produces an increasing magnetic field which induces, by transformer action, an ignition arc-sustaining potential in the secondary winding of a magnitude sufficient to maintain a previously initiated ignition arc, for example, 2400 volts; the cross-section area of the magnetic iron of the core of the ignition coil must be great enough that the core does not saturate during the periods the switching transistor is operating in the On mode and the primary winding must have an inductance value which, with rated primary winding energizing current flow therethrough, will provide sufficient stored energy to charge the total secondary output capacitance to a desired peak value, whereby upon the operation of the switching transistor to the Off mode an ignition spark potential will be induced in the secondary winding which rapidly increases toward a value in excess of that required to initiate an ignition arc, and to maintain an ignition arc during the periods the switching transistor is operating in the Off mode.

Without intention or inference of a limitation thereto, in the remainder of this specification, two practical embodiments of the internal combustion engine ignition system of this invention are described in detail.

In FIGS. 1 and 2 of the drawings, wherein like elements have been assigned like characters of reference, respective embodiments of the internal combustion engine ignition system of this invention are set forth in schematic form in combination with a source of direct current potential, which may be a conventional storage battery 3, and an ignition distributor 6 having a movable electrical contact 7, rotated in timed relationship with an associated engine, through which ignition spark energy is directed to the spark plugs of the engine individually, in a manner well known in the automotive art.

The internal combustion engine with which both hereindescribed specific embodiments of the ignition system of this invention may be used is set forth in block form, is referenced by the numeral 10 and is illustrated as having four spark plugs 1S, 2S, 3S and 4S, each having an arc gap in communication with the combustion chamber of the associated cylinder, as is well known in the automotive art. It is to be specifically understood, however, that both embodiments of the ignition system of this invention may be used with internal combustion engines having more or less cylinders and also with rotary type engines.

Preferably mounted within ignition distributor 6 is a pair of ignition distributor breaker contacts 4 which are operated to the electrical circuit open and closed conditions in timed relationship with engine 10 by a distributor cam 8 rotated by engine 10 in a manner well known in the automotive art. Capacitor 2 is the ignition capacitor connected across the breaker contacts 4.

To supply operating potential to either embodiment, movable contact 11 of an electrical switch 13 may be closed to stationary contact 12 to supply battery potential across lead 14 and point of reference or ground potential 5. Movable contact 11 and stationary contact 12 of electrical switch 13 may be a pair of normally open ignition contacts included in a conventional automotive ignition switch of the type well know in the automotive art. For purposes of the following description, it will be assumed that movable contact 11 is closed to stationary contact 12.

The ignition coil 18 of each embodiment has a magnetic core 17, a primary winding 15, and a secondary winding 16. During the buildup of the flow of an energizing current through primary winding 15, a magnetic flux in core 17 is produced in approximate proportion to the current. This flux links the secondary winding 16, which is connected to the movable electrical contact 7 of ignition distributor 6. An arc-initiating potential of sufficient magnitude to initiate an ignition arc across the arc gap of the spark plugs 1S, 2S, 3S or 4S connected by distributor 7 is induced by inductive discharge action in secondary winding 16 upon the interruption of the flow of energizing current through primary winding 15, in a manner well known in the automotive art. The primary winding turns ratio of the transformer, and the energizing primary current at the moment of interruption are chosen to produce a voltage spike at this time sufficient to produce an arc. The off period subsists for a sufficiently short time after the arc is initiated to maintain the ignition arc across each spark plug arc gap as the inductive current decrement takes place. Ignition coil 18 is additionally designed to have a primary to secondary windings turns ratio such that, during the buildup of energizing current through primary winding 15, a potential of sufficient magnitude to maintain the ignition arc initiated across each spark plug arc gap is induced by transformer action in secondary winding 16. If desirable, ignition coil 18 may have an open magnetic core. That is, magnetic core 17 may have an air gap of the order of .015 inch, as is well known in the automotive art. In an exemplary practical application of the ignition system of this invention, ignition coil 18 had 11 primary winding turns and 2200 secondary winding turns, which is a turns ratio of 1:200; a primary winding energizing current maximum at the time of interruption of about 30 amperes at 12 primary winding volts, and a primary winding inductance of 200 microhenries. The stored primary winding energy ($W_p$) in joules is equal to one-half the product of the primary winding inductance (L) in henries and the square of the primary winding energizing current (I) in amperes, as expressed by the formula $W_p = (LI^2/2)$ joules. Therefore, with a primary winding inductance of 200 microhenries and a primary winding energizing current of 30 amperes, this coil provided 90 milljoules of stored primary winding energy.

In both embodiments herein described, the electrical switching device is of a type which may be operated in response to electrical signals to the electrical circuit off and on conditions for the flow of energizing current from the source of direct current potential, battery 3, through the primary winding 15 of ignition coil 18. This switching device is shown as a type NPN transistor 20. However, any other electrical switching device having similar electrical characteristics may be substituted therefor without departing from the spirit of the invention. The collector electrode 22 and emitter electrode 23 of the transistor 20, and primary winding 15 of ignition coil 18, are connected in series across the battery 3, through switch 13 and lead 14 and through point of reference or ground potential 5.

Referring to the embodiment of FIG. 1, while engine 10 is in the running mode, ignition distributor breaker contacts 4 are operated to the electrical circuit open condition each time one of the equally spaced lobes of ignition distributor cam 8 passes by cam follower or rubbing block 9. Upon each operation of breaker contacts 4 to the electrical circuit open condition, a positive voltage increase defining a timing signal appears across junction 25 and point of reference or ground potential 5. In this embodiment, wherein each ignition event is a predetermined number of degrees of crankshaft rotation, the equally spaced lobes of distributor cam 8 are designed to maintain ignition distributor breaker contacts 4 open for such predetermined number of degrees of engine crankshaft rotation. This is the period of time ignition spark energy is applied to each spark plug of the engine. Therefore, as engine 10 rotates distributor cam 8 to operate breaker contacts 4 open and closed, a timing signal for each successive spark plug firing of engine 10 is produced across junction 25 and the point of reference or ground potential 5, and is maintained for a duration of time corresponding to the period of time ignition spark energy is to be applied to the spark plug.

For purposes of this specification, and without intention or inference of a limitation thereto, it will be assumed that ignition spark energy is to be applied to each of spark plugs 1S, 2S, 3S and 4S of engine 10 for a period of 45 crankshaft degrees which, at 1000 rpm, is equal to 7.50 milliseconds of time. Therefore, each one of the equally spaced four lobes of ignition distributor cam 8 is designed to maintain ignition breaker contacts 4 open for 45° of crankshaft rotation of engine 10. This timing signal is illustrated by curve A of FIG. 3 at 1000 engine rpm which is a duration of 7.50 milliseconds.

The timing signal is filtered by the resistor 26 and capacitor 27 filter circuit combination and shaped to a substantially square waveform electrical signal by a conventional signal shaper circuit 30. As this signal shaper circuit may be any one of the many conventional signal shaper circuits well known in the electronics art, it has been illustrated in block form. A signal shaper circuit suitable for use with this application is set forth schematically in FIG. 4 and explained in detail later in this specification.

Each of the filtered and shaped timing signals is applied to the input circuit of an oscillator circuit, which may be a gated free-running multivibrator circuit 40 which produces a series of output signals of the same polarity and of a predetermined repetition rate in response to and for the duration of each one of the timing signals. A gated free-running multivibrator circuit operates as a free-running oscillator so long as a potential is applied thereto, in a manner well known in the art. Without intention or inference of a limitation thereto, in a practical application of the ignition system circuit of this invention, this gated free-running multivibrator circuit had a frequency of 1 kilocycle per second. As gated free-running multivibrator circuit 40 may be any one of the many conventional gated free-running multivibrator circuits well known in the electronics art, it has been illustrated in block form. One example of a gated free-running multivibrator circuit suitable for use with this application is schematically set forth in FIG. 5 and explained in detail later in this specification. The series of output signals produced by gated free-running multivibrator circuit 40 are of a positive polarity with respect to point of reference or ground potential 5, as illustrated by curve B of FIG. 3 which shows these signals to begin upon the occurrence of a timing signal and cease at the end of the timing signal. The output signals produced by gated free-running multivibrator circuit 40 are applied to the base-emitter space path of transistor 20, which serves as the electrical switching device to open and close the circuit through primary 15. The positive output signals of gated free-running multivibrator circuit 40 are applied across the base electrode 21 and emitter electrode 23 of NPN switching transistor 20 in the proper polarity relationship to produce base-emitter drive current and, consequently, collector-emitter conduction, through the NPN transistor 20.

PRACTICAL SYSTEM OPERATION

Upon the occurrence of the initial positive output signal of the series of electrical output signals produced by gated free-running multivibrator circuit 40, switching transistor 20 is thus rendered conductive through the collector-emitter electrodes. During the time period T1, curve B of FIG. 3, of the initial positive polarity output signal of multivibrator circuit 40, switching transistor 20 conducts, completing a circuit for the flow of ignition coil primary winding energizing current. The circuit may be traced from the positive polarity terminal of battery 3 through switch 13, lead 14, primary winding 15, the collector-emitter electrodes of switching transistor 20 and point of reference or ground potential 5 to the negative polarity terminal of battery 3. The primary winding energizing current increases approximately linearly during time period T1, as shown in FIG. 3C, and produces a progressively increasing magnetic flux. This links secondary winding 16 and induces therein, by transformer action, an ignition arc-sustaining potential of approximately 2400 volts. At the end of the on period, approximately 90 millijoules of energy is stored in the transformer. The arc-sustaining potential induced in secondary winding 16 is of no important effect during time period T1 as it typically requires 9 kilovolts to 18 kilovolts to initiate an ignition arc across the arc gap between the electrodes of the engine spark plug to which it is directed. At the conclusion of the initial positive polarity signal from gated free-running multivibrator circuit 40, i.e., the end of time period T1 and the beginning of time period T2, transistor 20 abruptly interrupts the ignition coil primary winding energizing circuit. The resulting rapidly collapsing magnetic field induces, by induction coil action, an ignition arc-initiating potential in secondary winding 16 of ignition coil. As secondary winding 16 is open-circuited at the time of the interruption of the primary winding energizing circuit, the arc-initiating potential induced in secondary winding 16 increases rapidly, curve D of FIG. 3, producing a voltage spike as shown. This voltage rises rapidly to 14 kilovolts or more, for example, which is great enough to ionize the gas within the arc gap between the electrodes of the engine spark plug to which it is directed and initiate an ignition arc across the arc gap of that spark plug. Following arc initiation, the voltage across the secondary winding falls in inductive decrement action, that is, with the rate of change of flux progressively declining. As shown in curve 3D, the potential during the balance of time period T2 progressively declines to say, 2 kilovolts. This value is sufficient to maintain the ignition arc current, curve E of FIG. 3.

Upon the occurrence of the next positive polarity output signal of the series of output signals of gated free-running multivibrator circuit 40, i.e., time period T3, transistor 20 is again rendered conductive through the collector-emitter electrodes to complete the ignition coil primary winding energizing circuit to supply current to the ignition coil primary winding 15, as shown in curve C of FIG. 3. The flow of energizing current through ignition coil primary winding 15 is initially of a magnitude determined by the energy level remaining in the coil at the end of the inductive decrement action period and the secondary load current picked up by the primary winding at the start of the transformer action period T3 and increases during the time period T3. The consequent increasing magnetic field induces, by transformer action, an ignition arc-sustaining potential in secondary winding 16 of a sufficient magnitude, such as approximately 2400 volts, to maintain the ignition arc across the fired plug, curve D of FIG. 3, and again stores energy in primary winding 15. At the conclusion of this positive polarity output signal from gated free-running multivibrator circuit 40, the end of time period T3, transistor 20 extinguishes to abruptly interrupt the ignition coil primary winding energizing circuit. The resulting rapidly collapsing magnetic field induces, by induction coil action, the arc-initiating potential of a negative polarity in secondary winding 16 which, with the arc previously subsisting, is limited to approximately 2 kilovolts, the magnitude required to maintain the ignition arc of the fired plug, curve D of FIG. 3. This sequence continues so long as multivibrator circuit 40 produces successive positive polarity output signals, i.e., until the end of the timing signal.

It may be noted that the time period T1 of the initial output signal pulse of free-running multivibrator circuit 40 is of a longer duration than the subsequent output signal pulses. This longer duration initial pulse provides a longer period of time for the flow of ignition coil primary winding energizing current. Preferably, the primary winding energizing current increases in magnitude from zero to approximately the same maximum value during the initial period T1 that it reaches at the conclusion of each subsequent free-running multivibrator pulse, such as T3. This insures that sufficient energy is stored in the primary winding during the initial free-running multivibrator output signal pulse, time period T1, to produce an ignition arc when the primary winding energizing circuit is abruptly interrupted at the beginning of time period T2, and at the same time an unnecessarily high current is not created and required to be interrupted in the subsequent periods such as T3. The free-running multivibrator circuit described hereafter with respect to FIG. 5 inherently tends to provide the longer initial output pulse. In the alternative, the on periods T1, T3, etc. can be terminated in response to predetermined instantaneous current so as to always interrupt the same current at the termination of each on period.

Should the ignition arc extinguish at any time during the period of any of the timing signals, the next interruption of the flow of energizing current through ignition coil primary winding 15 produces a spark-initiating potential in secondary winding 16 by inductive coil action in the same manner as above described with respect to the first such interruption (end of period T1). In this fashion the present invention provides an ignition arc restrike capability at the end of each time period during which the switching transistor is operated in the on mode.

As shown in curve D, FIG. 3, the polarity of the ignition coil secondary voltage reverses at the end of the respective primary current on and primary current off periods. As the current wave thus passes through zero, the instantaneous current in the arc is zero. However, the time rate of voltage change across the arc at each such occasion is so rapid that the arc space remains ionized and the arc is quickly re-established at a relatively low voltage without requiring the large voltage necessary to strike the arc after it has been off for a significant period. In the present description we have described the arc as being normally continuous for the duration of the ignition period, but it should be understood that this is so only in the practical sense of continued ionization and since the voltage across the arc does instantaneously pass through zero.

In the event that for some reason the arc does not strike on the initial voltage spike at the beginning of time period T2, FIG. 3 (or the corresponding time at the beginning of a later current off period when the arc is out), or has been extinguished prior to such time, the voltage across the ignition coil secondary winding 16 goes to a very high value, such as 40 kilovolts. This high voltage capability, coupled with the rapid rate of voltage increase hereinafter described, aids in the establishment or re-establishment of the arc under adverse conditions.

During the transformer action period (i.e., current flow in primary 15), the potential induced in secondary winding 16 may produce more arc current flow than is desirable. Such flow, reflected in the primary, unnecessarily increases the current requirement of transistor 20. To reduce the current, a resistor is connected in series with each of the engine spark plugs and has an ohmic value which will limit the ignition arc current to a desired value, for example 50 milliamperes, thereby avoiding unnecessary primary winding current. These resistors are referenced in the drawing by numerals 1R, 2R, 3R and 4R, respectively.

It is apparent from the curves of FIG. 3 that from the beginning of the timing signal, curve A, to the initiation of the ignition spark which occurs at the beginning of arc current, curve E, there is a fixed time delay equal to the time period required for the ignition coil primary winding energizing current to reach a predetermined magnitude. The fixed time delay between the beginning of the timing signal and the initiation of the spark results in a retardation of the spark, as is well known in the automotive art. This spark retard is compensated for by the initial distributor timing and the use of the proper spark advance curve. For example, a spark retard of about 0.5 milliseconds between the beginning of the timing signal and the initiation of the ignition spark requires a distributor spark advance compensation of about 3° per 1000 engine rpm.

The duration of the total arcing period, that is, the 7.5 millisecond period shown in FIG. 3A, may be determined in several ways. One way, illustrated in FIG. 1 and described above, is by crankshaft angle. With reference to FIG. 1, the cam 8 rotates at half of crankshaft speed (in a four stroke cycle engine) and has four flats as illustrated (for a four-cylinder engine). The cam follower, indicated at 9, rides on the cam and supports the movable contact arm in conventional manner as shown, so that the contacts 4 make contact four successive times for every full rotation of cam 8. The configuration of the cam, together with the follower 9, and the adjustment of the contacts 4, collectively cause the contacts 4 to be in open position for a predetermined portion of the time as the cam rotates, for example 45 crankshaft degrees as discussed above. Using this control, the duration of the arc increases as speed decreases a feature that provides a generally desirable increased arc duration for cranking and slow speed engine operation. It should be noted, however, that unlike conventional Kettering type ignition systems, this increased arc duration does not involve increased current interruption requirements but instead only increases the number of on and off periods that occur during the arc period. If desired, a magnetic pickup arrangement may be used in lieu of the cam type shown in FIG. 1, in which event the duration of the arcing time can be similarly set. In another variation, which has been successfully used, the arc termination may be effected by a separate turn-off signal responsive to a specific crankshaft position, such as top dead center of the piston involved. In either event, the duration of the arcing time established by crankshaft angle is not related to the period of current buildup in the transformer winding and in this respect is unlike the "dwell" period setting of a conventional Kettering type ignition system.

In the alternative, the arc duration may be controlled independently of crankshaft position, as by a separate time control. Such arrangement is described hereafter with reference to FIG. 2. In an arrangement of this type, the time can be programmed in response to engine speed deceleration, or some other factor conducive to improved engine operation. For example, the duration may be extremely long for engine start, may be somewhat extended during deceleration, and may be rather short for normal running, so as to accommodate engine characteristics.

As shown by FIG. 3C, there is no "holding" of some current flow in the primary winding 15 prior to interruption to produce an inductive discharge. Rather, the current is abruptly terminated while it is still increasing in approximately linear fashion. In this respect the system of the present invention is unlike the conventional Kettering type system. There are two basic ways to control the time when the current is interrupted in the system of the present invention, time control and current feedback control. Time control is described above with reference to FIG. 1 and FIG. 3. By this technique the length of each on time of transistor 20 is controlled, as by the period of the free-running multivibrator 40. In this arrangement, the multivibrator may be adjusted (as by a bias voltage applied to terminal D, FIG. 5), to program the on time in accordance with variations in supply voltage or other variables, as desired.

Current feedback control of the on time of the primary winding 15 causes abrupt interruption of current flow when some predetermined instantaneous current value is reached. With a free-running multivibrator such as illustrated at 40, FIG. 1, and in the illustrative circuit arrangement of FIG. 5, a voltage responsive to the current flow in the winding 15 can be fed back to the terminal D, so as to trigger the multivibrator slightly in advance of the time it would self-trigger. An exemplary circuit for this purpose is shown in fragmentary form in FIG. 1A. In this circuit, a resistance 100 is provided in the path of the current flow through winding 15 and transistor 20 so as to develop a positive-going voltage in proportion to such current flow, thus producing a wave form like FIG. 3C. This voltage is applied to the base of transistor 102 to produce a supply of current carriers therein in proportion to the voltage. The resultant current reduces the voltage at terminal D more rapidly than otherwise so as to advance the time of multivibrator shift. The multivibrator is designed to operate free-running so as to terminate each on period at a slightly later time than is required to produce the desired interrupt current in the winding 15. The feedback circuit of FIG. 1A thus accelerates the free-running action so as to trigger the multivibrator off at the proper advanced time wherein the predetermined current value desired is interrupted at the instant such current occurs in the primary winding. Preferably, the feedback circuitry includes non-linear elements (not shown) which sharply increases the voltage applied to the base electrodes of transistor 102 as the current in winding 15 approaches the desired cutoff value, so that the multivibrator is positively and accurately turned off when the desired current is reached. Capacitor 44 should be sized to minimize the effect of this feedback action on the off time. Alternatively, current feedback may be achieved by other circuitry, such as that described in corresponding U.S. patent application Ser. No. 401,505.

Current feedback control is advantageous in that the value of the current on interruption, and hence the inductive discharge arc-creating voltage applied to the spark plugs, is at a uniform, high value, and at the same time the system is not required to handle any greater interrupt load, nor need it be designed to achieve the necessary transformer action at a higher current. It will be noted by reference to FIG. 3C that after the first on time, each primary winding current wave commences with a substantial initial current. The initial magnitude of this current is determined by the energy remaining in the coil at the end of the inductive decrement discharge period and the secondary current picked up by the primary winding at the start of the transformer action period. With current feedback control of the duration of the subsequent on time, the duration of such subsequent on times is significantly shorter than the first on time, as shown in FIG. 3. The current feedback control thereby compensates for the initial current and advantageously holds the current interrupted at a uniform value.

The duration of each current off time is preferably made substantially constant. In the circuit above-described with reference to FIG. 1 and having the operating characteristics illustrated in FIG. 3, this off time is the restoration period of the free-running multivibrator, described hereafter in further detail with reference to FIG. 5. It has been found that the off period can advantageously be made substantially equal to the on period, as described above, a characteristic that is readily achieved with a multivibrator of the type shown in FIG. 5. In any arrangement, the duration of the off period is made no greater than the time period the arc can be maintained by inductive discharge action, so that when the next on time is initiated there is an existing arc and transformer action alone sufficient to maintain the arc thereafter, as described above. It is desirable to terminate each off period when the secondary voltage has fallen to the lowest value that reliably sustains the arc.

The pertinent specifications of each of three illustrative ignition transformers that have been employed in practical applications of the novel internal combustion ignition system of this invention are set forth in the following table:

| | COIL No. 1 | COIL No. 2 | COIL No. 3 |
|---|---|---|---|
| PRIMARY TURNS | 11 | 17 | 11 |
| SECONDARY TURNS | 2200 | 3000 | 3000 |
| PRIMARY INDUCTANCE (microhenries) | 200 | 350 | 150 |
| SECONDARY INDUCTANCE (henries) | 8.2 | 14.4 | 14.4 |
| PRIMARY CURRENT AT TIME OF INTERRUPTION (amperes) | 30 | 15 | 30 |
| STORED ENERGY (millijoules) | 90 | 57 | 90 |
| MAGNETIC CORE AREA (inches) | .625 | .625 | .625 |
| AIR GAP (inches) | .008 | .008 | .008 |

With each of the above transformers and a 12 volt battery, arc durations of the order of 7.5 milliseconds, peak arc currents of the order of 85 milliamperes, and total arc energies of the order of 400 millijoules can be obtained.

The foregoing transformer designs importantly differ from equivalent designs made for conventional Kettering type systems with a single primary current interruption for each ignition period. In such conventional systems, it is desirable to maintain the arc by inductive decrement action for a substantial period, such as 1.8 milliseconds in a high energy system. In a system constructed in accordance with the present invention, the arc needs to be maintained by such action only for a shorter period, such as 500 microseconds. It is therefore possible with the present invention to design the transformer with a relatively smaller number of secondary turns (and corresponding number of primary turns). Further, by winding the secondary with many layers separated with paper or other insulation and with a space between each turn, the secondary capacity can be effectively reduced. We have produced transformers having secondary capacitance approximately one-fifth of that required for a conventional equivalent high energy system. This very low output capacitance provides a faster voltage rise and a higher maximum peak arc-striking voltage than otherwise, both of which characteristics aid in establishing the arc under adverse conditions.

DESCRIPTION OF ILLUSTRATIVE COMPONENT CIRCUITS

The signal shaper circuit 30 and the gated free-running multivibrator circuit 40 used with practical applications of the internal combustion engine ignition system circuit of this invention are set forth schematically in respective FIGS. 4 and 5 and employ two input NAND gates. The NAND gate is a commercially available logic circuit element well known in the art which requires a logic 1 signal on each of the input terminals to produce a logic 0 signal upon the output terminal thereof. NAND gates suitable for use for this application are marketed by RCA under the designation, "Type CD4011." For purposes of this specification, a logic 1 signal is a potential signal of a positive polarity and a logic 0 signal is of ground potential.

Referring to FIG. 4, the signal shaper circuit used with the embodiments of FIGS. 1 and 2 is set forth schematically. A logic 0 input signal applied to both input terminals of NAND gate 31, in parallel, through input terminal 33 and input resistor 34 produces a logic 1 signal upon the output terminal thereof. This logic 1 signal, applied to both input terminals of NAND gate 32, in parallel, produces a logic 0 signal upon the output terminal thereof and the signal shaper circuit output terminal 35. A logic 1 signal applied to both input terminals of NAND gate 31, in parallel, through input terminal 33 and input resistor 34 produces a logic 0 signal upon the output terminal thereof. This logic 0 signal is applied to both input terminals of NAND gate 32, in parallel, which results in a logic 1 signal upon the output terminal thereof and upon the signal shaper circuit output terminal 35. Feedback resistor 36 serves to produce a sharp switching action, consequently, the output signal of this signal shaper circuit is of a square waveform pulse having substantially vertical leading and trailing edges. This signal shaper circuit may be employed with the embodiments of FIGS. 1 and 2 by connecting input terminal 33 to junction 24 between resistor 26 and capacitor 27. While the ignition distributor breaker contacts 4 are operated to the electrical circuit closed condition, a logic 0 signal is applied to both input terminals of NAND gate 31 and while the ignition distributor breaker contacts 4 are operated to the electrical circuit open condition, a logic 1 signal is applied to both input terminals of NAND gate 31. Consequently, this signal shaper circuit will produce a square waveform logic 1 signal output pulse of a width equal to the duration of time that the ignition distributor breaker contacts 4 are operated to the electrical circuit open condition.

Referring to FIG. 5, the gated free-running multivibrator circuit used with the embodiment of FIG. 1 is set forth schematically. The application of a logic 0 signal, curve A of FIG. 5, to one of the input terminals of NAND gate 41 connected to the free-running multivibrator circuit input terminal 43 produces a logic 1 signal upon the output terminal thereof, curve B of FIG. 5. This logic 1 signal is applied to both input terminals of NAND gate 42, in parallel, which results in a logic 0 signal upon the output terminal thereof, curve C of FIG. 5, and commences the charge of capacitor 44 through the parallel combination of resistor 46 and resistor 59 and diode 47 in series and the output transistor of NAND gate 42, curve D of FIG. 5. When capacitor 44 has become charged, a logic 1 signal is present upon the other input terminal of NAND gate 41 through resistor 48. The application, at this time, of a logic 1 signal to the one of the input terminals of NAND gate 41 connected to input terminal 43, curve A of FIG. 5, produces a logic 0 signal upon the output terminal thereof, curve B of FIG. 5. This logic 0 signal is applied to both input terminals of NAND gate 42, in parallel, which results in a logic 1 signal upon the output terminal thereof, curve C of FIG. 5, and also upon the free-running multivibrator circuit output terminal 45. With a logic 0 output signal present upon the output terminal of NAND gate 41 and a logic 1 output signal present upon the output terminal of NAND gate 42, the potential of the signal present upon junction D, curve D of FIG. 5, substantially doubles, as the potential of this signal is added to the potential of the charge upon capacitor 44, and capacitor 44 begins to discharge to ground through resistor 46 and the output transistor of NAND gate 41. As capacitor 44 discharges, the potential of the signal upon junction D reduces in magnitude toward a logic 0 signal or ground potential, curve D of FIG. 5, until it reaches a magnitude at which it appears as a logic 0 signal upon the input terminal of NAND gate 41 connected thereto through resistor 48. At this time, a logic 1 signal appears upon the output terminal of NAND gate 41, curve B of FIG. 5, and a logic 0 signal appears upon the output terminal of NAND gate 42, curve C of FIG. 5, and capacitor 44 again begins to charge through the charging circuit previously described. The sequence just described repeats so long as a logic 1 signal is maintained upon the gated free-running multivibrator circuit input terminal 43, consequently, this gated free-running multivibrator circuit produces a series of substantially square waveform logic 1 output signals upon the output terminal 45 thereof of a frequency as determined by the R-C time constant of the discharge circuit for capacitor 44. As an output signal appears upon output terminal 45 while capacitor 44 is discharging, the ohmic value of resistor 46 determines both the frequency and the on time of this free-running multivibrator circuit. If desired, and as above described with reference to FIG. 1A, the duration of the on time may be controlled by an appropriate trigger signal applied to point D, FIG. 5. The series combination of resistor 59 and diode 47 is connected in parallel with resistor 46 to provide a low impedance path through which capacitor 44 may rapidly charge with the presence of a logic 1 signal upon the output terminal of NAND gate 41 and a logic 0 signal upon the output terminal of NAND gate 42. To use this gated free-running multivibrator circuit with the embodiment of FIG. 1, input terminal 43 is connected to the output terminal of signal shaper circuit 30, output terminal 35 of the signal shaper circuit of FIG. 4 if this circuit is so used, and output terminal 45 is connected to the switching transistor 20. While the ignition distributor breaker contacts 4 are operated to the electrical circuit closed condition, a logic 0 signal is applied to the one of the input terminals of NAND gate 41 connected to input terminal 43 and while the ignition distributor breaker contacts 4 are operated to the electrical circuit open condition, a logic 1 signal is applied to the one input terminal of NAND gate 41 connected to input terminal 43. Consequently, this gated free-running multivibrator circuit will continue to oscillate and produce a series of logic 1 output signals for the duration of the timing signal.

In a practical application of the circuit of this invention, the output transistor of NAND gate 42 of the gated free-running multivibrator circuit 40 was incapable of supplying sufficient drive current to produce collector-emitter saturation conduction in the ignition coil primary winding switching transistor 20. Consequently, a transistor driver circuit, as schematically set forth in FIG. 6, was employed. The input terminal 52 of the transistor driver circuit is connected to the output terminal 45 of the multivibrator circuits of FIGS. 5 and 8. A type NPN transistor Darlington pair, referenced by the numerals 20*a* and 20*b* in FIG. 6, may be substituted for ignition coil primary winding switching transistor 20 should the magnitude of the desired energizing current for primary winding 15 so dictate. With lead 51 connected to the positive polarity terminal of a direct current potential source and driver circuit input terminal 52 connected to an external source of logic 0 and logic 1 signals, the presence of a logic 0 signal upon input terminal 52 provides a forward anode-cathode bias for diode 53 which conducts to complete a circuit for the flow of current from lead 51 through resistor 54, diode 53 and the external signal source. With diode 53 conducting, diode 56 compensates for the voltage drop thereacross, therefore, the potential upon junction 58 is of an insufficient magnitude to produce base-emitter drive current through NPN transistor 50, consequently, the remainder of the circuit is inactive. With a logic 1 signal present upon input terminal 52, diode 53 is reverse biased thereby and, consequently, is not conductive. With diode 53 not conductive, battery potential is applied across the series combination of resistor 54, diode 56 and resistor 57 which produces a flow of current therethrough which develops a potential across resistor 57 of a positive polarity upon junction 58 with respect to point of reference or ground potential 5. Resistor 57 improves the turn-off time of transistor 50 and provides noise immunity. With diode 53 reverse biased, the potential upon junction 58 is of a sufficient magnitude to produce base-emitter drive current and, consequently, collector-emitter current flow through type NPN transistor 50 which are connected across the source of direct current potential through series resistors 61 and 62. Conducting transistor 50 completes a circuit through which emitter-base drive current is supplied to type PNP transistor 60, consequently, this device conducts through the emitter-collector electrodes and supplies base drive current, through resistor 63, to type NPN transistor 20*a* of the transistor Darlington pair. This base drive current produces collector-emitter conduction through transistors 20*a* and 20*b* of the Darlington pair to complete the ignition coil primary winding energizing circuit. Resistors 64 and 65 are included to improve the recovery time of transistors 20*a* and 20*b*. To use this driver circuit with the embodiment of FIG. 1, lead 51 is connected to the positive polarity terminal of battery 3 and input terminal 52 is connected to the output terminal 45 of gated free-running multivibrator circuit 40, if the gated free-running multivibrator circuit of FIG. 5 is so employed. Consequently, each logic 1 output signal from gated free-running multivibrator circuit 40 triggers the ignition coil primary winding switching transistor 20 or the switching transistor Darlington pair 20*a* and 20*b* conductive through the collector-emitter electrodes to complete the ignition coil primary winding energizing circuit. It is to be specifically understood that this transistor driver circuit is not absolutely necessary to the invention as alternate circuit elements may be employed for gated free-running multivibrator circuit 40 which will supply sufficient drive current to the ignition coil primary winding switching transistor.

In the embodiment of FIG. 2, the timing signals, curve A of FIG. 3, are produced by a potential controllable monostable multivibrator circuit 70 and the series of logic 1 output signals, curve B of FIG. 3, which operate ignition coil primary winding switching transistor 20 conductive through the collector-emitter electrodes are produced by a potential controllable gated free-running multivibrator circuit 75. As is well known in the art, the monostable multivibrator circuit normally operates in a stable state and may be switched to an alternate state by an electrical signal, in which it remains for a period of time as determined by an internal R-C timing network. After timing out, the device spontaneously returns to the stable state. The time that a potential controllable monostable multivibrator circuit remains in the alternate state may be selectively varied in response to a control potential signal of a variable magnitude and the frequency and on time of the output signals of a potential controllable gated free-running multivibrator circuit may be selectively varied in response to a control potential signal of a variable magnitude.

While engine 10 is in the running mode, ignition distributor breaker contacts 4 are operated to the electrical circuit open condition each time one of the lobes of ignition distributor cam 8 passes by cam follower or rubbing block 9. Upon each operation of breaker contacts 4 to the electrical circuit open condition, an electrical signal appears across junction 25 and point of reference or ground potential 5 of a positive polarity upon junction 25 with respect to point of reference or ground potential 5. This electrical signal is filtered by the resistor 26 and capacitor 27 filter circuit combination and shaped to a substantially square waveform electrical signal by signal shaper circuit 30. Each of the filtered and shaped electrical signals is applied to the input circuit of a potential controllable monostable multivibrator circuit 70 to switch this device to its alternate state. Potential controllable monostable multivibrator circuit 70 remains in the alternate state, in which a logic 1 signal is present upon the output terminal thereof, for a duration of time as determined by an internal R-C timing network. After this device has timed out, it spontaneously returns to the stable state of operation, in which a logic 0 signal is present upon the output terminal thereof. Consequently, potential controllable monostable multivibrator circuit 70 produces the ignition signals, curve A or FIG. 3, of this embodiment of the internal combustion engine ignition system of this invention. Each of the timing signals produced by potential controllable monostable multivibrator circuit 70 is applied to the input terminal of a potential controllable gated free-running multivibrator circuit 75 which produces a series of output signals of the same polarity and of a repetition rate as determined by the magnitude of the control potential signal applied thereto for the duration of each one of the timing signals. As with the embodiment of FIG. 1, potential controllable gated free-running multivibrator circuit 75 may have a fundamental output frequency of 1 kilocycle per second. The output signals of potential controllable gated free-running multivibrator circuit 75 are applied across the base-emitter electrodes of NPN switching transistor 20 in the proper polarity relationship to produce base-emitter drive current and, consequently, collector-emitter conduction, through an NPN transistor. As with the embodiment of FIG. 1, should a type PNP transistor be selected as the electrical switching device, the series of output signals produced by potential controllable gated free-running multivibrator circuit 75 must be of a negative or ground potential. In the event the output device of potential controllable gated free-running multivibrator circuit 75 is incapable of supplying sufficient drive current to switching transistor 20 to produce collector-emitter saturation, the transistor drive circuit schematically set forth in FIG. 6 may be employed.

From this description, it is apparent that the embodiment of FIG. 2 differs from the embodiment of FIG. 1 to the extent that the timing signals are produced by a potential controllable monostable multivibrator circuit, hence, the duration thereof may be adjusted, as required, by varying the magnitude of a control potential signal to which this device is responsive and the series of electrical signals produced during each of the timing signals for operating switching transistor 20 conductive through the collector-emitter electrodes are produced by a potential controllable gated free-running multivibrator circuit, hence, the frequency and on time of these signals may be varied for controlling the arc current and potential, as required, by varying the magnitude of a control potential signal to which this device is responsive. That is, the arc duration may be selected as determined by engine requirements by establishing the length of time potential controllable monostable multivibrator circuit 70 is in the alternate state and the arc current and maximum potential may be varied as determined by the engine requirements by selecting the on time of each of the series of output signals produced by potential controllable gated free-running multivibrator circuit 75. The longer the on time of each of these output signals, the greater the magnitude of the ignition coil primary winding energizing current, hence, a higher arc current and maximum potential because of the additional energy stored therein with the increased magnitude of energizing current. The control potential signal applied to potential controllable monostable multivibrator circuit 70 and the other control potential signal applied to potential controllable gated free-running multivibrator circuit 75 may be proportional to selected external conditions such as ambient temperature, ambient pressure, engine temperature, engine vacuum, engine speed, atmospheric humidity, and so forth.

The potential controllable monostable multivibrator circuit 70 and the potential controllable gated free-running multivibrator circuit 75 used with practical applications of the internal combustion engine ignition system of this invention are set forth schematically in respective FIGS. 7 and 8. The potential controllable monostable multivibrator circuit employs a type "D" flip-flop circuit and both the potential controllable monostable multivibrator circuit and the potential controllable gated free-running multivibrator circuit employ a field effect transistor. The type D flip-flop circuit is a commercially available logic circuit element well known in the art which in the "Set" condition produces a logic 1 signal upon the "Q" output terminal thereof, in the "Reset" condition produces a logic 0 signal upon the Q output terminal thereof and transfers the logic signal present upon the D input terminal to the Q output terminal upon the application of a logic 1 signal to the "C" clock input terminal. A type D flip-flop circuit suitable for use with this application is marketed by RCA under the designation "Type CD4013". The field effect transistor is a commercially available device which normally conducts current through the source-drain electrodes except when a control potential is applied to the control electrode. A field effect transistor suitable for use with this application may be of the P channel enhancement type marketed by RCA under the designation, "CD4007". A field effect transistor of this type conducts current through the source-drain electrodes and the degree of this conduction may be controlled by a control potential signal of a positive polarity applied to the control electrode thereof, the larger the magnitude of the control potential signal the smaller the degree of source-drain conduction. Consequently, a field effect transistor may be employed as a variable resistor by varying the magnitude of the control potential signal applied to the control electrode thereof.

Referring to FIG. 7, the potential controllable monostable multivibrator circuit used with the embodiment of FIG. 2 is set forth schematically. With the D input terminal of type D flip-flop circuit 80 connected to the positive polarity output terminal of a source of direct current operating potential, a logic 1 signal is maintained thereupon. With type D flip-flop circuit 80 in the Reset condition, with a logic 0 signal upon the Q output terminal thereof, upon the rise of a logic 1 signal, curve A of FIG. 7, applied to the C clock input terminal through input terminal 71, the logic 1 signal upon the D input terminal is transferred to and appears as a logic 1 signal upon the Q output terminal thereof, curve B of FIG. 7, and flip-flop circuit 80 is in the Set condition. This logic 1 signal charges capacitor 74 through resistor 72 and the parallel combination of resistor 73 and the source-drain electrodes of field effect transistor 85, curve C of FIG. 7. The charge upon capacitor 74 is applied to the R Reset terminal of type D flip-flop circuit 80, consequently, when capacitor 74 has become charged to a potential of a sufficient magnitude to reset type D flip-flop circuit 80, point R of curve C of FIG. 8, this device is reset to the condition in which a logic 0 signal is present upon the Q output terminal thereof, curve B of FIG. 8. At this time, capacitor 74 discharges through diode 76 and resistor 72 and the current carrying electrodes of the output transistor of type D flip-flop circuit 80, as shown by the trailing edge of curve C of FIG. 8. This potential controllable monostable multivibrator circuit may be employed with the embodiment of FIG. 2 by connecting input terminal 71 to the output terminal 35 of the signal shaper circuit 30 of FIG. 4 and the D input terminal may be connected to lead 14 of FIG. 2. Assuming that type D flip-flop circuit 80 is in the Reset condition, the substantially vertical leading edge of the logic 1 square wave output signal of signal shaper circuit 30 is applied as a logic 1 clock pulse to the C clock input terminal of type D flip-flop circuit 80 through input terminal 71 to transfer the logic 1 signal present upon the D terminal to the Q output terminal. Consequently, the leading edge of the logic 1 output signal of signal shaper circuit 30 triggers the monostable multivibrator circuit 70 to the alternate state in which type D flip-flop circuit 70 is in the Set condition with a logic 1 signal upon the Q output terminal thereof. Monostable multivibrator circuit 70 remains in this alternate state for a period of time as determined by the R-C time constant of the charging circuit, previously described, for capacitor 74 and spontaneously reverts to the stable state in which type D flip-flop circuit 80 is in the Reset condition with a logic 0 signal upon the Q output terminal thereof when the charge upon capacitor 74 has reached a sufficient magnitude to reset type D flip-flop circuit 80. The time *t* during which monostable multivibrator circuit 70 is in the alternate state with a logic 1 signal upon the Q output terminal of type D flip-flop circuit 80 and potential controllable monostable multivibrator circuit output terminal 77 is the timing signal of this embodiment. The period of time that type D flip-flop circuit 80 is in the Set condition with a logic 1 signal present upon the Q output terminal thereof, which is the period of time monostable multivibrator circuit 70 is in the alternate state, is determined by the R-C time constant of the charging circuit, previously described, of capacitor 74. The source-drain electrodes of field effect transistor 85 are connected in parallel with resistor 73 in the charging circuit of capacitor 74 which is resistor 72 connected in series with the parallel combination of resistor 73 and the source-drain electrodes of field effect transistor 85, consequently, field effect transistor 85 may be employed as a variable resistor to vary the R-C time constant of this charging circuit. By varying the magnitude of a control potential signal of a positive polarity applied through input terminal 78 to control electrode 85*a* of field effect transistor 85, the degree of source-drain conduction therethrough may be varied to vary the R-C time constant of the charge circuit of capacitor 74. As an output timing signal appears upon output terminal 77 while capacitor 74 is charging, the length of time monostable multivibrator circuit 70 is in the alternate state, and hence, the duration of the timing signal may be selectively varied or controlled by varying the magnitude of a control potential signal applied to input terminal 78.

Referring to FIG. 8, the potential controllable gated free-running multivibrator circuit used with the embodiment of FIG. 2 is set forth schematically. This potential controllable gated free-running multivibrator circuit is similar to that set forth in FIG. 5, differing only to the extent that resistor 49 and field effect transistor 95 are added. Consequently, the elements of FIG. 8, which are identical to corresponding elements of FIG. 5, have been assigned like characters of reference. In the circuit of FIG. 8, field effect transistor 95 is employed as a variable resistor and resistor 49 is included for the purpose of supplying the proper bias potential to the drain electrode thereof. The source-drain electrodes of field effect transistor 95 are connected in parallel with resistor 46, in the discharge circuit of capacitor 44. This discharge circuit is resistor 49 in series with the parallel combination of resistor 46 and the source-drain electrodes of field effect transistor 95, consequently, field effect transistor 95 may be employed as a variable resistor to vary the R-C time constant of this discharge circuit. By varying the magnitude of a control potential signal of a positive polarity applied through input terminal 88 to control electrode 95a of field effect transistor 95, the degree of source-drain conduction therethrough may be varied to vary the R-C time constant of the discharge circuit of capacitor 44. As an output signal appears upon output terminal 45 while capacitor 44 is discharging, the on timing of this potential controllable gated free-running multivibrator circuit may be selectively varied or controlled by varying the magnitude of a control potential signal applied to input terminal 88. This potential controllable gated free-running multivibrator circuit may be employed with the embodiment of FIG. 2 by connecting input terminal 43 to the output terminal 77 of the monostable multivibrator circuit of FIG. 7, if this circuit is so used, and output terminal 45 is connected to the switching transistor 20. As with the embodiment of FIG. 1, if the output device of potential controllable gated free-running multivibrator circuit 75 is incapable of supplying sufficient drive current to produce collector-emitter saturation conduction through the ignition coil primary winding switching transistor 20, input terminal 52 of a transistor driver circuit as schematically set forth in FIG. 6 may be connected to output terminal 45. While an ignition signal is being produced by potential controllable monostable multivibrator circuit 70 in a manner previously described, a logic 1 signal is applied through input terminal 43 of FIG. 8 to the input terminal of NAND gate 41 of the potential controllable gated free-running multivibrator circuit 75 of FIG. 8 connected thereto, consequently, this gated free-running multivibrator circuit will oscillate and produce a series of logic 1 output signals for the duration of each timing signal.

In FIG. 9, an alternate embodiment in which the ignition signals are produced by a magnetic type distributor is set forth. Magnetic distributors of this type are well known in the automotive art and are comprised of a rotor member 82 rotated by an associated internal combustion engine within the bore of a pole piece 83 which is magnetized by an annular permanent magnet, not shown. As rotor member 82 is rotated by the engine, an alternating current signal, as shown, is induced in pickup coil 84 which is filtered by the combination of resistor 81 and capacitor 86 and supplied through current limiting resistor 87 to the positive input terminal of a comparator circuit 90. The comparator circuit is a commercially available logic circuit element well known in the art having a positive polarity input terminal and a negative polarity input terminal. When the magnitude of a logic signal applied to the positive polarity input terminal is greater than the magnitude of a logic signal applied to the negative polarity input terminal thereof, a logic 1 signal appears upon the output terminal and when the magnitude of a logic signal is applied to the positive polarity input terminal is of a magnitude less than that of a logic signal applied to the negative polarity input terminal, a logic 0 signal appears upon the output terminal thereof. A comparator circuit suitable for use with this application is marketed by Motorola, Inc. under the designation "Type MC3302P". The output terminal of comparator circuit 90 is connected to the positive polarity terminal of battery 3 through resistor 91 and to the positive polarity input terminal thereof through feedback resistor 92. To provide a comparison signal upon the negative polarity input terminal, the series combination of resistor 93 and resistor 94 are connected in series across the positive polarity terminal of battery 3 and point of reference or ground potential 5. When the signals induced in pickup coil 84 are of a magnitude less positive than the comparison signal upon junction 96 between series resistors 93 and 94, a logic 0 signal appears upon the output terminal 96 of comparator circuit 90 and when these signals are of a magnitude more positive than the comparison signal upon junction 96, a logic 1 signal appears upon the output terminal 97 until the potential induced in the pickup coil 84 reduces to a magnitude less positive than the comparison signal upon junction 96. The feedback resistor 92 provides a sharp switching action. Comparator circuit 90, therefore, functions as a signal shaper circuit which produces an output signal of a square waveform having substantially vertical leading and trailing edges. Output terminal 97 may be connected to the input terminal of gated free-running multivibrator circuit 40 of the embodiment of FIG. 1. Like the ignition distributor breaker contacts 4 of the embodiment of FIG. 1, the signal from the magnetic distributor sets the arc duration to a predetermined number of degrees of engine crankshaft rotation with this connection. The square wave output signal of comparator circuit 90 may also be employed as the timing signal, in which event the output terminal 97 is connected to the input terminal of potential controllable monostable multivibrator circuit 70 of the embodiment of FIG. 2 to transfer this circuit to the alternate state.

By providing successive transformer action, induction discharge action, and inductive decrement action through successive short primary current on and off events, the present invention achieves advantages that include the following:

1. The effective ignition arc duration may be preselected for a relatively long period of time.

2. Arc current sufficient to maintain the arc is provided over the entire ignition arc duration which results in high arc energy.

3. As the ignition coil primary winding energizing circuit switching device is operated alternately to the on and off modes at a high frequency, typically one kilocycle, the ignition system of this invention avoids long periods of dwell before the initiation of each ignition arc, thereby permitting higher primary peak current without dangerously overheating the switching device or the transformer.

4. As the stored energy need only sustain an ignition arc between successive energizations of the primary winding, typically 500 microseconds, fewer primary winding turns are required than in equivalent high energy systems, typically 10 or 11 primary winding turns, as opposed to 100 or more primary winding turns of prior art transformers.

5. As fewer primary winding turns are required, fewer secondary winding turns are required, typically 3000 secondary winding turns with the transformer of this invention as opposed to 9000 or more secondary winding turns of an equivalent high energy system.

6. As fewer secondary turns are required, the secondary winding turns may be wound in layers separated from each other by paper and the turns of each layer may be spaced, a condition which reduces the secondary capacitance of the transformer, typically 20 micro-microfarads for the transformer of this invention as opposed to 100 micro-microfarads of an equivalent conventional high energy system prior art transformer, which results in a rapid rise time and a higher maximum peak potential.

7. The transistor switch employed in the primary winding energizing circuit is operated either off or in a saturated, lowest resistance, condition. This minimizes heating of the transistor and reduces the required transistor size and heat dissipation.

8. Electrical energy requirement is comparatively low because the system uses a single transformer and operates in an arc-maintaining low energy mode except on the recurrent moments of restrike capability.

9. The system readily accommodates varying types of control for the duration of the arc, the current at the end of each on time, and may be otherwise adapted to specific engine requirements and programmed to accommodate variations of the same with engine speed and other operating conditions.

Throughout this specification, specific electrical circuit elements, logic circuit elements, transistor types, electrical circuits and electrical polarities have been set forth in detail. It is to be specifically understood that alternate electrical circuit elements, logic circuit elements, transistor types, electrical circuits and compatible electrical polarities may be substituted therefor without departing from the spirit of the invention.

In the foregoing description, the secondary current after the arc strike is described as being in the "inductive decrement" mode. By this, we mean the progressively decreasing current flow due to the secondary inductance from the initial current value at a time constant determined by the arc resistance. Prior to arc strike, the secondary experiences an abrupt voltage spike due to inductive action, but at this time there is no significant current.

While a preferred embodiment of the present invention has been shown and described, it will be obvious to those skilled in the art that various modifications and substitutions may be made without departing from the spirit of the invention which is to be limited only within the scope of the appended claims.

What is claimed is:

1. An internal combustion engine ignition system for use with an engine having at least one ignition arc-gap in communication with a combustion chamber and across which an ignition arc is produced to initiate combustion within the chamber, and a source of unidirectional voltage, said system comprising:

an ignition transformer having a primary winding and a secondary winding, the primary to secondary winding turns ratio being such as to produce in conjunction with the voltage of said source a secondary voltage sufficient to maintain an arc across said gap when the same has been instituted and for a first period of time, during which time primary current increases substantially linearly, the transformer further producing an arc-creating voltage in the secondary winding upon interruption of the current developed by the end of said time period, and maintaining the arc thereafter in inductive decrement action for a second period of time;

an electrical switching device operable to on and off modes in response to first and second applied voltage conditions, respectively;

a primary winding energizing circuit including said source, said device, and said primary winding in series;

a secondary circuit including said secondary winding and said arc-gap in series;

an oscillator effective when not energized to produce said second applied voltage condition and operable when energized to oscillate independently of engine operation from said first to said second applied voltage conditions, and vice versa, in said first period of time and said second period of time, respectively, whereby at the conclusion of each said second period of time when an arc subsists an abrupt current increase occurs in the primary winding;

means responsive to instantaneous primary current flow to trigger the oscillator to terminate each said first period of time when the primary current reaches a predetermined value; and means effective to energize said oscillator for a longer on period at low engine speed than at high engine speed.

2. An internal combustion engine ignition system for use with an engine having at least one ignition arc-gap in communication with a combustion chamber and across which an ignition arc is produced to initiate combustion within the chamber, and a source of unidirectional voltage, said system comprising:

an ignition transformer having a primary winding and a secondary winding, the primary to secondary winding turns ratio being such as to produce in conjunction with the voltage of said source a secondary voltage sufficient to maintain an arc across said gap when the same has been instituted and for a first period of time, during which time primary current increases substantially linearly, the transformer further producing an arc-creating voltage in the secondary winding upon interruption of the current developed by the end of said time period, and maintaining the arc thereafter in inductive decrement action for a second period of time;

an electrical switching device operable to on and off modes in response to first and second applied voltage conditions, respectively;

a primary winding energizing circuit including said source, said device, and said primary winding in series;

a secondary circuit including said secondary winding and said arc-gap in series;

an oscillator effective when not energized to produce said second applied voltage condition and operable when energized to oscillate independently of engine operation from said first to said second applied voltage conditions, and vice versa, in said first period of time and said second period of time, respectively, whereby at the conclusion of each said second period of time when an arc subsists an abrupt current increase occurs in the primary winding; and means responsive to instantaneous primary current flow to trigger the oscillator to terminate each said first period of time when the primary current reaches a predetermined value.

3. An internal combustion engine ignition system for use with an engine having at least one ignition arc-gap in communication with a combustion chamber and across which an ignition arc is produced to initiate combustion within the chamber, and a source of unidirectional voltage, said system comprising: an ignition transformer having a primary winding and a secondary winding, said transformer being capable of producing an arc-creating voltage in the secondary winding thereof for instituting an ignition arc across said ignition arc gap upon interruption of primary winding energizing current and of maintaining the ignition arc thereafter in inductive decrement action for a first period of time and having a primary to secondary winding turns ratio such as to produce in conjunction with the voltage of said source a secondary voltage sufficient to maintain a previously instituted ignition arc across said ignition arc gap for a second period of time during which primary winding energizing current increases substantially linearly; an electrical switching device operable to on and off modes in response to first and second applied voltage conditions, respectively; a primary winding energizing circuit including said source, said device, and said primary winding in series; a secondary circuit including said secondary winding and said arc-gap in series; an oscillator effective when not energized to produce said second applied voltage condition and operable when energized to oscillate independently of engine operation from said second to said first applied voltage conditions, and vice versa, during said first period of time and said second period of time, respectively, whereby an ignition arc existing at the conclusion of each said first period of time is maintained continuously during each following said second period of time by the abrupt increase of energizing current in the ignition transformer primary winding; and means effective to energize said oscillator circuit for a longer on period at low engine speed than at high engine speed.

4. An internal combustion engine ignition system for use with an engine having at least one ignition arc-gap in communication with a combustion chamber and across which an ignition arc is produced to initiate combustion within the chamber, and a source of unidirectional voltage, said system comprising:

an ignition transformer having a primary winding and a secondary winding, the primary to secondary winding turns ratio being such as to produce in conjunction with the voltage of said source a secondary voltage sufficient to maintain an arc across said gap when the same has been instituted and for a first time period of the order of 500 microseconds, during which time primary current increases substantially linearly, the transformer further producing an arc-creating voltage in the secondary winding upon interruption of the current developed by the end of said time period, and maintaining the arc thereafter for a second time period of the order of 500 microseconds;

an electrical switching device operable to on and off modes in response to first and second applied voltage conditions, respectively;

a primary winding energizing circuit including said source, said device, and said primary winding in series;

a secondary circuit including said secondary winding, and said arc-gap in series;

an oscillator effective when not energized to produce said second applied voltage condition and operable when energized to oscillate independently of engine operation between said first and second applied voltage conditions with periods of the order of 500 microseconds in each condition;

means connecting the oscillator to said switching device to actuate the switching device to said on and off modes in accordance with said first and second applied voltage conditions produced by the oscillator;

means operable in response to engine operation and substantially 500 microseconds in advance of the time an ignition arc is to be initiated to energize said oscillator; and means to deenergize the oscillator a plurality of oscillations thereafter.

5. An internal combustion engine ignition system for use wih an engine having at least one ignition arc-gap in communication with a combustion chamber and across which an ignition arc is produced to initiate combustion within the chamber, and a source of unidirectional voltage, said system comprising: an ignition transformer having a primary winding and a secondary winding, said transformer being capable of producing an arc-creating voltage in the secondary winding thereof for instituting an ignition arc across said ignition arc gap upon interruption of primary winding energizing current and of maintaining the ignition arc thereafter in inductive decrement action for a first period of time and having a primary to secondary-winding turns ratio such as to produce in conjunction with the voltage of said source a secondary voltage sufficient to maintain a previously instituted ignition arc across said ignition arc gap for a second time period during which primary winding energizing current increases substantially linearly; an electrical switching device operable to on and off modes in response to first and second applied voltage conditions, respectively; a primary winding energizing circuit including said source, said device, and said primary winding in series; a secondary circuit including said secondary winding and said arc-gap in series; an oscillator effective when not energized to produce said second applied voltage condition and operable when energized to oscillate independently of engine operation between said first and second applied voltage conditions with respective dwell times of said second and first time periods, respectively; means connecting the oscillator to said switching device to actuate the switching device to said on and off modes in accordance with said first and second applied voltage conditions produced by the oscillator whereby an ignition arc existing at the conclusion of each said first period of time is maintained continuously during each following said second time period; means operable in advance of the time an ignition arc is to be initiated to energize said oscillator; and means to deenergize the oscillator a plurality of oscillations thereafter.

6. An internal combustion engine ignition system for use with an engine having at least one ignition arc-gap in communication with a combustion chamber and across which an ignition arc is produced to initiate combustion within the chamber, and a source of unidirectional voltage, said system comprising:

an ignition transformer having a primary winding and a secondary winding, the primary to secondary winding turns ratio being such as to produce in conjunction with the voltage of said source a secondary voltage substantially in excess of that required to maintain an arc across said gap when the same has been instituted, and for a time of the order of 500 microseconds, the transformer further being sized to produce an arc-creating voltage in the secondary winding upon interruption of the current developed by the end of said time, and to maintain the arc thereafter for a period of about 500 microseconds;

an electrical switching device operable to on and off modes;

a primary winding energizing circuit including said source, said device, and said primary winding in series;

a resistance;

a secondary circuit including said second winding, said resistance, and said arc-gap in series, the value of said resistance being such as to reduce the current in the arc to approximately the value required to maintain the arc during said first mentioned time;

means for operating said electrical switching device to said on mode at a time an ignition arc is to be initiated and for a time of the order of 500 microseconds so as to produce an arc-creating potential on current interruption; and means for shifting said electrical switching device to said off mode at the conclusion of said time and thereafter to operate said electrical switching device alternately between said on and off modes for times of the order of 500 microseconds each and for a predetermined ignition arc duration.

7. An internal combustion engine ignition system for use with an engine having at least one ignition arc-gap in communication with a combustion chamber and across which an ignition arc is produced to initiate combustion within the chamber, and a source of unidirectional voltage, said system comprising:

an ignition transformer having a primary winding and a secondary winding, the primary to secondary winding turns ratio being such as to produce in conjunction with the voltage of said source a secondary voltage sufficient to maintain an arc across said gap when the same has been instituted, and for a time of the order of 500 microseconds, the transformer further being sized to produce an arc-creating voltage in the secondary winding upon interruption of the current developed by the end of said time and to maintain the arc thereafter for a period of almost 500 microseconds;

an electrical switching device operable to on and off modes;

a primary winding energizing circuit including said source, said device, and said primary winding in series;

a secondary circuit including said secondary winding and said arc-gap in series;

means for operating said electrical switching device to said on mode at a time an ignition arc is to be initiated and for a time of the order of 500 microseconds so as to produce an arc-creating potential on current interruption; and means for shifting said electrical switching device to said off mode at the conclusion of said time and thereafter to operate said electrical switching device alternately between said on and off modes for times of the order of 500 microseconds each and for a predetermined ignition arc duration.

8. An internal combustion engine ignition system for use with engines of the type having at least one combustion chamber having an ignition arc-gap in communication therewith across which an ignition arc is produced to initiate combustion therein comprising in combination with a source of direct current potential;

an ignition transformer having a primary winding and a secondary winding, the primary to secondary winding turns ratio being such that for a limited time an ignition arc-sustaining potential is induced, by transformer action, in said secondary winding as a result of increasing primary winding energizing current flow upon the energization of said primary winding by said source of direct current potential;

an electrical switching device operable to on and off modes;

a primary winding energizing circuit including said source of direct current potential, said electrical switching device and said primary winding;

a secondary circuit including said secondary winding and said arc gap;

means for operating said electrical switching device to said on mode at a time an ignition arc is to be initiated for a time sufficient to produce an arc-creating potential on current interruption; and means for shifting said electrical switching device to said off mode at the conclusion of a predetermined period of time independent of engine operation and thereafter to operate said electrical switching device alternately between said on and off modes for a predetermined ignition arc duration, each operation to said off mode being sufficiently abrupt to induce an ignition arc-initiating potential in said secondary winding which rapidly increases in magnitude toward a value substantially in excess of that required to initiate an ignition arc, and the duration of each off mode being sufficiently short to maintain an arc-sustaining voltage as the voltage decays during the remainder of the off period and each on period being shorter than said limited time and sufficiently long to create an arc-creating potential on current interruption.

9. An internal combustion engine ignition system for use with an engine of the type having at least one combustion chamber having an arc-gap in communication therewith across which an ignition arc is produced to initiate combustion therein comprising in combination with a source of direct current potential;

an ignition coil having a primary winding and a secondary winding in which an ignition arc-initiating potential for initiating an ignition arc is induced upon the interruption of the flow of predetermined energizing current through said primary winding, and thereafter maintains a previously initiated ignition arc for a predetermined time, said ignition coil having a primary to secondary winding turns ratio such that an ignition arc-sustaining potential of more than about one kilovolt is induced for a limited time in said secondary winding as a result of an increasing primary winding energizing current flow through said primary winding;

an electrical switching device operable to on and off modes;

a primary winding energizing circuit including said electrical switching device, said primary winding and said source of direct current potential;

a secondary circuit including said secondary winding and said arc-gap; and means for operating said electrical switching device to said on mode at the time an ignition arc is to be initiated thereafter for operating, independent of engine operation, said electrical switching device to said off mode when the energizing current has at least said predetermined value for thereafter operating said electrical switching device alternately between said on and off modes for a predetermined ignition arc duration, each on mode being of a duration to produce current of at least said predetermined value and being less than said limited time, and each off mode being less than said predetermined time, whereby, when there is no previously initiated ignition arc, upon each operation of said electrical switching device to said off mode, an ignition arc-creating voltage is produced across said arc-gap and at all other times an ignition arc-maintaining voltage subsists.

10. An internal combustion engine ignition system comprising in combination with a source of direct current potential; means for producing a timing signal corresponding to each spark plug of the engine in timed relationship with and during each revolution of the crankshaft of the engine of a duration corresponding to the period of time ignition spark energy is to be applied to the spark plug to which it corresponds; an electrical oscillator circuit for producing a series of output signals of a predetermined repetition rate in response to and for the duration of each one of said timing signals; an ignition coil having a primary winding and a secondary winding in which an ignition spark potential of sufficient magnitude to initiate an ignition arc across the arc-gap of each of the engine spark plugs is induced upon the interruption of the flow of energizing current through said primary winding, said primary winding having an inductance value which, with a predetermined magnitude of energizing current, will provide sufficient stored energy to maintain the ignition arc initiated across each spark plug arc-gap for a duration of time at least as long as the period between said electrical output signals of said oscillator and said ignition coil having a primary to secondary winding turns ratio such that, during the buildup of energizing current through said primary winding, a potential of sufficient magnitude to maintain the ignition arc initiated across each spark plug arc-gap is induced in said secondary winding; and means responsive to said series of oscillator output signals for establishing a primary winding energizing circuit for the flow of energizing current from said source of direct current potential through said ignition coil primary winding during the period of each of said series of oscillator output signals and for interrupting said primary winding energizing circuit upon the termination of each of said oscillator output signals whereby an ignition arc initiated upon the interruption of said primary winding energizing circuit is maintained continuously during the period of each of said timing signals.

11. An internal combustion engine ignition system comprising in combination with a source of direct current potential and an ignition distributor having an electrical contact rotated in timed relationship with the engine through which ignition spark potential is applied to the spark plugs of the engine individually; means for producing a timing signal corresponding to each spark plug of said engine in timed relationship with and during each revolution of the crankshaft of said engine of a duration corresponding to the period of time ignition spark energy is to be applied to the said spark plug to which it corresponds; an electrical oscillator circuit for producing a series of output signals of a predetermined repetition rate in response to and for the duration of each one of said timing signals; an ignition coil having a magnetic core, a primary winding which, during the buildup of the flow of an energizing current therethrough, produces a magnetic flux in said core and a secondary winding, connected to said electrical contact of said distributor, in which an ignition spark potential of sufficient magnitude to initiate an ignition arc across the arc-gap of each of said spark plugs is induced upon the interruption of the flow of energizing current through said primary winding, said primary winding having an inductance value which, with a predetermined magnitude of energizing current, will provide sufficient stored energy to maintain the ignition arc initiated across each spark plug arc-gap for a duration of time at least as long as the period between successive energizations thereof and said ignition coil having a primary to secondary winding turns ratio such that, during the buildup of energizing current through said primary winding, a potential of sufficient magnitude to maintain the ignition arc initiated across each spark plug arc gap is induced in said secondary winding; and means responsive to said series of oscillator output signals for establishing a primary winding energizing circuit for the flow of energizing current from said source of direct current potential through said ignition coil primary winding during the period of each of said series of oscillator output signals and for interrupting said primary winding energizing circuit upon the termination of each of said oscillator output signals whereby an ignition arc initiated upon the interruption of said primary winding energizing circuit is maintained continuously during the period of each of said timing signals.

12. An internal combustion engine ignition system comprising in combination with a source of direct current potential and an ignition distributor having an electrical contact rotated in timed relationship with the engine through which ignition spark potential is applied to the spark plugs of the engine individually; means for producing a timing signal corresponding to each spark plug of said engine in timed relationship with and during each revolution of the crankshaft of said engine of a duration corresponding to the period of time ignition spark energy is to be applied to the said spark plug to which it corresponds; an electrical oscillator circuit for producing a series of output signals of the same polarity and of a predetermined repetition rate in response to and for the duration of each one of said timing signals; an ignition coil having a magnetic core, a primary winding which, during the buildup of the flow of an energizing current therethrough, produces a magnetic flux in said core and a secondary winding, connected to said electrical contact of said distributor, in which an ignition spark potential of sufficient magnitude to initiate an ignition arc across the arc-gap of each of said spark plugs is induced upon the interruption of the flow of energizing current through said primary winding, said primary winding having an inductance value which, with a predetermined magnitude of energizing current, will provide sufficient stored energy to maintain the ignition arc initiated across each spark plug arc-gap for a duration of time at least as long as the period between successive energizations thereof and said ignition coil having a primary to secondary winding turns ratio such that, during the buildup of energizing current through said primary winding, a potential of sufficient magnitude to maintain the ignition arc initiated across each spark plug arc-gap is induced in said secondary winding; and means responsive to said series of oscillator output signals for establishing a primary winding energizing circuit for the flow of energizing current from said source of direct current potential through said ignition coil primary winding during the period of each of said series of oscillator output signals and for interrupting said primary winding energizing circuit upon the termination of each of said oscillator output signals whereby an ignition arc initiated upon the interruption of said primary winding energizing circuit is maintained continuously during the period of each of said timing signals.

13. An internal combustion engine ignition system comprising in combination with a source of direct current potential and an ignition distributor having an electrical contact rotated in timed relationship with the engine through which ignition spark potential is applied to the spark plugs of the engine individually; means for producing a timing signal corresponding to each spark plug of said engine in timed relationship with and during each revolution of the crankshaft of said engine of a duration corresponding to the period of time ignition spark energy is to be applied to the said spark plug to which it corresponds; an electrical oscillator circuit for producing a series of output signals of a predetermined repetition rate in response to and for the duration of each one of said timing signals; an ignition coil having a magnetic core, a primary winding which, during the buildup of the flow of an energizing current therethrough, produces a magnetic flux in said core and a secondary winding, connected to said electrical contact of said distributor, in which an ignition spark potential of sufficient magnitude to initiate an ignition arc across the arc-gap of each of said spark plugs is induced upon the interruption of the flow of energizing current through said primary winding, said primary winding having an inductance value which, with a predetermined magnitude of energizing current, will provide sufficient stored energy to maintain the ignition arc initiated across each spark plug arc-gap for a duration of time at least as long as the period between successive energizations thereof and said ignition coil having a primary to secondary winding turns ratio such that, during the buildup of energizing current through said primary winding, a potential of sufficient magnitude to maintain the ignition arc initiated across each spark plug arc-gap is induced in said secondary winding; an electrical switching device having current carrying members and being of the type which may be operated to the electrical circuit open and closed conditions in response to electrical signals; means for connecting said current carrying members of said electrical switching device and said primary winding of said ignition coil in series across said source of direct current potential; and means for applying said output signals of said oscillator circuit to said electrical switching device whereby an ignition arc initiated upon the operation of said electrical switching device to the electrical circuit open condition is maintained continuously during the period of each of said timing signals.

14. An internal combustion engine ignition system for use with an engine having at least one ignition arc-gap in communication with a combustion chamber and across which an ignition arc is produced to initiate combustion within the chamber, and a source of unidirectional voltage, said system comprising:

an ignition transformer having a primary winding and a secondary winding, the primary to secondary winding turns ratio being such as to produce in conjunction with the voltage of said source a secondary voltage sufficient to maintain an arc across said gap when the same has been instituted and for a first period of time, during which time primary current increases substantially linearly, the transformer further producing an arc-creating voltage in the secondary winding upon interruption of the current developed by the end of said time period, and maintaining the arc thereafter in inductive decrement action for a second period of time;

an electrical switching device operable to on and off modes in response to first and second applied voltage conditions, respectively;

a primary winding energizing circuit including said source, said device, and said primary winding in series;

a secondary circuit including said secondary winding and said arc-gap in series;

an oscillator effective when not energized to produce said second applied voltage condition and operable when energized to oscillate independently of engine operation from said first to said second applied voltage conditions, and vice versa, in said first period of time and said second period of time, respectively, whereby at the conclusion of each said second period of time when an arc subsists an abrupt current increase occurs in the primary winding; said oscillator being constructed and arranged to produce a first on time of greater duration than subsequent on times in amount tending to make the current interrupted upon institution of each off time substantially the same.

15. An internal combustion engine ignition system comprising in combination with a source of direct current potential and an ignition distributor having an electrical contact rotated in timed relationship with the engine through which ignition spark potential is applied to the spark plugs of the engine individually; means for producing a timing signal corresponding to each spark plug of said engine in timed relationship with and during each revolution of the crankshaft of said engine of a duration corresponding to the period of time ignition spark energy is to be applied to the said spark plug to which it corresponds; an ignition coil having a magnetic core, a primary winding which, during the buildup of the flow of an energizing current therethrough, produces a magnetic flux in said core and a secondary winding, connected to said electrical contact of said distributor, in which an ignition spark potential of sufficient magnitude to initiate an arc across the spark gap of each of said spark plugs is induced upon the interruption of the flow of energizing current through said primary winding, said primary winding having an inductance value which, with a predetermined magnitude of energizing current, will provide sufficient stored energy to maintain the arc initiated across each spark plug spark gap for a predetermined duration of time and said ignition coil having a primary to secondary winding turns ratio such that, during the buildup of energizing current through said primary winding, a potential of sufficient magnitude to maintain the arc initiated across each spark plug spark gap is induced in said secondary winding; an ignition coil primary winding energizing circuit through which energizing current flows from said source of direct current potential through said ignition coil primary winding; means responsive to the flow of energizing current through said ignition coil primary winding energizing circuit for producing an electrical potential signal of a magnitude proportional to the magnitude of said flow of energizing current; means for producing a plurality of control signals during each said timing signal, each in response to said electrical potential signal of a predetermined magnitude; and means responsive to said timing signal for establishing and to each of said control signals for interrupting said ignition coil primary winding energizing circuit.

16. An internal combustion engine ignition system comprising in combination with a source of direct current potential and an ignition distributor having an electrical contact rotated in timed relationship with the engine through which ignition spark potential is applied to the spark plugs of the engine individually; means for producing a timing signal corresponding to each spark plug of said engine in timed relationship with and during each revolution of the crankshaft of said engine of a duration corresponding to the period of time ignition spark energy is to be applied to the said spark plug to which it corresponds; an ignition coil having a magnetic core, a primary winding which, during the buildup of the flow of an energizing current therethrough, produces a magnetic flux in said core and a secondary winding, connected to said electrical contact of said distributor, in which an ignition spark potential of sufficient magnitude to initiate an arc across the spark gap of each of said spark plugs is induced upon the interruption of the flow of energizing current through said primary winding, said primary winding having an inductance value which, with a predetermined magnitude of energizing current, will provide sufficient stored energy to maintain the arc initiated across each spark plug spark gap for a predetermined duration of time and said ignition coil having a primary to secondary winding turns ratio such that, during the buildup of energizing current through said primary winding, a potential of sufficient magnitude to maintain the arc initiated across each spark plug spark gap is induced in said secondary winding; an ignition coil primary winding energizing circuit through which energizing current flows from said source of direct current potential through said ignition coil primary winding; an impedance element included in said ignition coil primary winding energizing circuit for producing an electrical potential signal of a magnitude proportional to the magnitude of said flow of energizing current; means for producing a plurality of control signals during each said timing signals, each in response to said electrical potential signal of a predetermined magnitude; and means responsive to said signal for establishing and to each of said control signals for interrupting said ignition coil primary winding energizing circuit.

* * * * *